US012686553B2

(12) United States Patent
Hansen et al.

(10) Patent No.: US 12,686,553 B2
(45) Date of Patent: Jul. 21, 2026

(54) FOLDING CONTAINER WITH COVER

(71) Applicant: California Innovations Inc., Toronto (CA)

(72) Inventors: Rebecca Hansen, Scarborough (CA); Tommy Hawes, Toronto (CA)

(73) Assignee: CALIFORNIA INNOVATIONS INC. (CA)

( * ) Notice: Subject to any disclaimer, the term of this patent is extended or adjusted under 35 U.S.C. 154(b) by 75 days.

(21) Appl. No.: 18/512,858

(22) Filed: Nov. 17, 2023

(65) Prior Publication Data

US 2025/0162783 A1 May 22, 2025

(51) Int. Cl.

| | |
|---|---|
| ***B65D 81/38*** | (2006.01) |
| ***B65D 33/02*** | (2006.01) |
| ***B65D 33/10*** | (2006.01) |
| ***B65D 43/16*** | (2006.01) |

(52) U.S. Cl.

CPC ..... *B65D 81/3888* (2013.01); *B65D 33/02* (2013.01); *B65D 33/10* (2013.01); *B65D 43/162* (2013.01); *B65D 2543/00194* (2013.01); *B65D 2543/00231* (2013.01)

(58) Field of Classification Search

CPC .... B65D 81/3888; B65D 33/02; B65D 33/10; B65D 43/162; B65D 2543/00194; B65D 2543/00231; B65D 25/02; B65D 11/22; B65D 11/26; B65D 11/28

USPC ..... 220/592.2, 640, 642

See application file for complete search history.

(56) References Cited

U.S. PATENT DOCUMENTS

| | | | |
|---|---|---|---|
| 1,627,344 | A | 5/1927 | Scott |
| 1,639,418 | A | 8/1927 | Washburn |
| 1,700,615 | A | 1/1929 | O'Brien |
| 1,732,098 | A | 10/1929 | Lessenhop |
| 1,762,527 | A | 6/1930 | Robinson |
| 1,922,485 | A | 8/1933 | McKee |
| 1,949,677 | A | 3/1934 | Crawford |
| 1,964,795 | A | 7/1934 | Frary |
| 1,973,880 | A | 9/1934 | Moody |

(Continued)

FOREIGN PATENT DOCUMENTS

| | | |
|---|---|---|
| CA | 2268375 | 11/1999 |

OTHER PUBLICATIONS

Screen captures from YouTube video entitled: "Picnic at Ascot: How to Open and Fold Hybrid Cooler", 15 pages, uploaded on Nov. 29, 2016 by Picnic At Ascot. Retrieved from Internet: https://www.youtube.com/watch?v=VXQexDAZcEk (Year: 2016).*

(Continued)

*Primary Examiner* — Stephen J Castellano
*Assistant Examiner* — Eric C Baldrighi
(74) *Attorney, Agent, or Firm* — OSTROLENK FABER LLP

(57) ABSTRACT

A soft sided insulated container assembly includes a first portion having an insulated, soft sided external wall structure, and a substantially rigid molded plastic frame that defines the opening of a receptacle of the soft-sided insulated main body of the container. The frame is removable from the main body. It has a rigid cover structure that includes a reinforcement member for engaging a land region of the molded frame, thereby tending to yield an interface tending to have a sealing relationship. The container is foldable, and has stiffening panels in the front and rear walls to facilitate folding.

23 Claims, 17 Drawing Sheets

(56) References Cited

U.S. PATENT DOCUMENTS

| | | | | |
|---|---|---|---|---|
| 2,289,254 | A | 7/1942 | Eagles | |
| 2,555,126 | A | 5/1951 | Greve | |
| 2,555,788 | A | 6/1951 | Donaldson | |
| 2,645,332 | A | 7/1953 | Martin et al. | |
| 2,720,208 | A | 10/1955 | Gellman | |
| 2,808,093 | A | 10/1957 | Gilman | |
| 2,827,096 | A | 3/1958 | Hinson | |
| 2,883,041 | A | 4/1959 | Pfeifer et al. | |
| 2,954,891 | A | 10/1960 | Imber | |
| 3,001,566 | A | 9/1961 | Lipsitz | |
| 3,238,002 | A | 3/1966 | O'Connell et al. | |
| 3,255,607 | A | 6/1966 | Bair et al. | |
| 3,295,709 | A | 1/1967 | Herrick et al. | |
| 3,390,703 | A | 7/1968 | Marlow | |
| 3,572,054 | A | 3/1971 | Curcio | |
| 3,791,547 | A | 2/1974 | Branscum | |
| 3,998,072 | A | 12/1976 | Shaw | |
| 4,050,264 | A | 9/1977 | Tanaka | |
| 4,085,785 | A | 4/1978 | Hoot | |
| 4,210,186 | A | 7/1980 | Belenson | |
| 4,260,004 | A | 4/1981 | Domke | |
| 4,286,440 | A | 9/1981 | Taylor | |
| 4,303,109 | A | 12/1981 | Cohen | |
| D273,522 | S | 4/1984 | Weinreb | |
| 4,468,933 | A | 9/1984 | Christopher | |
| 4,499,998 | A | 2/1985 | Carlson | |
| 4,506,769 | A | 3/1985 | Franco et al. | |
| 4,513,895 | A | 4/1985 | Leslie | |
| 4,537,313 | A | 8/1985 | Workman | 206/545 |
| 4,541,540 | A | 9/1985 | Gretz et al. | |
| 4,551,988 | A | 11/1985 | Petrantoni | |
| 4,598,746 | A | 7/1986 | Rabinowitz | |
| 4,610,286 | A | 9/1986 | Cyr | |
| 4,629,040 | A | 12/1986 | Jones | |
| 4,655,052 | A | 4/1987 | Garcia | |
| 4,673,117 | A | 6/1987 | Carlton | |
| 4,767,039 | A | 8/1988 | Jacober | |
| 4,805,776 | A | 2/1989 | Namgyal et al. | |
| 4,819,793 | A | 4/1989 | Willard et al. | |
| 4,877,128 | A | 10/1989 | Strickland | |
| 4,889,257 | A | 12/1989 | Steffes | |
| 4,916,923 | A | 4/1990 | Adams et al. | |
| 4,929,094 | A | 5/1990 | Becker | |
| 4,971,201 | A * | 11/1990 | Sathre | B65D 5/0055 229/199 |
| D312,530 | S | 12/1990 | Gallen et al. | |
| 4,984,662 | A | 1/1991 | Jacober | |
| 5,005,679 | A | 4/1991 | Hjelle | |
| 5,095,718 | A | 3/1992 | Orrmond et al. | |
| D328,550 | S | 8/1992 | Mogil et al. | |
| 5,251,460 | A | 10/1993 | DeMarco | |
| 5,354,131 | A | 10/1994 | Mogil | |
| 5,403,005 | A | 4/1995 | Melk | |
| 5,421,127 | A | 6/1995 | Jones | |
| 5,472,279 | A | 12/1995 | Lin | |
| D366,812 | S | 2/1996 | Collins et al. | |
| 5,490,396 | A | 2/1996 | Morris | |
| 5,501,338 | A | 3/1996 | Preston | |
| D369,065 | S | 4/1996 | Sylvestre et al. | |
| 5,505,307 | A | 4/1996 | Shink | 206/541 |
| D370,123 | S | 5/1996 | Klinger | |
| 5,524,761 | A | 6/1996 | Wayman | |
| 5,526,907 | A | 6/1996 | Trawick et al. | 190/111 |
| 5,568,735 | A | 10/1996 | Newkirk et al. | |
| 5,638,983 | A * | 6/1997 | Bazany | B65D 19/18 220/650 |
| 5,671,611 | A | 9/1997 | Quigley | |
| 6,027,249 | A | 2/2000 | Bielinski | |
| 6,067,816 | A | 5/2000 | Hodosh | |
| 6,068,402 | A | 5/2000 | Freese et al. | |
| 6,092,661 | A | 7/2000 | Mogil | |
| 6,105,844 | A | 8/2000 | Walters et al. | |
| 6,234,677 | B1 | 5/2001 | Mogil | |
| 6,238,091 | B1 | 5/2001 | Mogil | |
| 6,296,165 | B1 | 10/2001 | Mears | |
| 6,474,095 | B1 | 11/2002 | Chan | |
| 6,821,019 | B2 | 11/2004 | Mogil | |
| 7,162,890 | B2 | 1/2007 | Mogil et al. | |
| 7,597,478 | B2 | 10/2009 | Mogil et al. | |
| 7,669,436 | B2 | 3/2010 | Mogil et al. | |
| 7,682,080 | B2 | 3/2010 | Mogil | |
| 7,757,878 | B2 | 7/2010 | Mogil et al. | |
| 7,841,207 | B2 | 11/2010 | Mogil et al. | |
| 7,988,006 | B2 | 8/2011 | Mogil et al. | |
| 8,043,004 | B2 | 10/2011 | Mogil | |
| 8,061,159 | B2 | 11/2011 | Mogil et al. | |
| 8,096,442 | B2 | 1/2012 | Ramundi | |
| 8,191,747 | B2 | 6/2012 | Pruchnicki | |
| 8,348,510 | B2 | 1/2013 | Mogil | |
| 8,459,058 | B2 | 6/2013 | Mogil et al. | |
| 8,640,937 | B2 | 2/2014 | Pruchnicki | |
| 8,646,970 | B2 | 2/2014 | Mogil | |
| 8,777,045 | B2 | 7/2014 | Mitchell et al. | |
| 8,857,654 | B2 | 10/2014 | Mogil et al. | |
| 8,899,071 | B2 | 12/2014 | Mogil et al. | |
| 9,408,445 | B2 | 8/2016 | Mogil et al. | |
| 9,422,099 | B2 | 8/2016 | Mitchell et al. | |
| 9,809,376 | B2 | 11/2017 | Mitchell et al. | |
| 9,868,583 | B2 | 1/2018 | Mitchell et al. | |
| 10,098,427 | B2 | 10/2018 | Mogil et al. | |
| 10,138,048 | B2 | 11/2018 | Mitchell et al. | |
| 10,287,055 | B2 | 5/2019 | Mogil et al. | |
| 10,314,377 | B2 | 6/2019 | Mogil et al. | |
| 10,506,895 | B2 | 12/2019 | Mogil et al. | |
| 10,730,684 | B2 | 8/2020 | Mitchell et al. | |
| 10,806,225 | B2 | 10/2020 | Sitnikova | |
| 11,096,463 | B2 | 8/2021 | Stephens | |
| 11,097,887 | B2 | 8/2021 | Mogil et al. | |
| 11,401,099 | B2 | 8/2022 | Stephens et al. | |
| 11,434,052 | B2 | 9/2022 | Stephens et al. | |
| 11,518,583 | B2 | 12/2022 | Hawes et al. | |
| 11,666,179 | B2 | 6/2023 | Mogil et al. | |
| 11,913,707 | B2 | 2/2024 | Gagnon et al. | |
| 12,172,804 | B2 | 12/2024 | Hawes et al. | |
| 12,187,524 | B2 | 1/2025 | Stephens et al. | |
| 2002/0126920 | A1 | 9/2002 | Mogil | |
| 2004/0035143 | A1 | 2/2004 | Mogil | |
| 2004/0144783 | A1 | 7/2004 | Anderson et al. | |
| 2005/0056048 | A1 | 3/2005 | Fuchs | |
| 2005/0103044 | A1* | 5/2005 | Mogil | A45C 11/20 220/592.2 |
| 2005/0279123 | A1 | 12/2005 | Maldonado et al. | |
| 2008/0257896 | A1* | 10/2008 | Guy | A45C 5/045 220/592.2 |
| 2017/0280937 | A1* | 10/2017 | Mogil | F25D 3/08 |
| 2020/0113385 | A1 | 4/2020 | Mogil et al. | |
| 2022/0110423 | A1 | 4/2022 | Rodgers et al. | |
| 2022/0110424 | A1 | 4/2022 | Rodgers | |
| 2023/0329407 | A1 | 10/2023 | Rodgers | |
| 2024/0116677 | A1 | 4/2024 | Stephens et al. | |
| 2024/0260788 | A1 | 8/2024 | Mogil et al. | |
| 2025/0136351 | A1 | 5/2025 | Stephens et al. | |
| 2025/0162762 | A1 | 5/2025 | Hansen et al. | |
| 2025/0162782 | A1 | 5/2025 | Hansen et al. | |
| 2025/0162783 | A1 | 5/2025 | Hansen et al. | |

OTHER PUBLICATIONS

2004 Igloo Products Catalogue, © 2003 Part 7.
2004 Igloo Products Catalogue, © 2003 Part 8.
Igloo Times, 2003 Igloo Products Catalogue, © 2002.
MaxCold™ 10, Igloo Times p. 21, 2003 Igloo Products Catalogue, © 2002.
Canadian Office Action dated Jul. 7, 2010, Canadian Patent Application No. 2,509,503.
Canadian Office Action dated Jul. 15, 2010, Canadian Patent Application No. 2,444,155.
Igloo EcoCool 3 Can Roller images https://www.rei.com/product/233397/igloo-ecocool-36-can-roller-cooler.

* cited by examiner

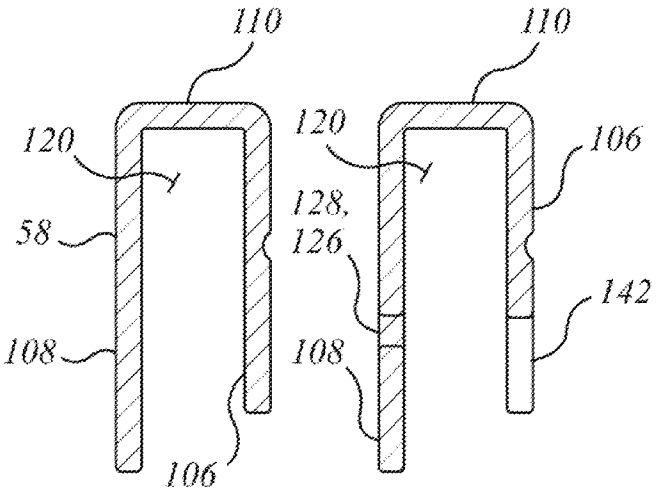
Fig. 3e
Fig. 3d
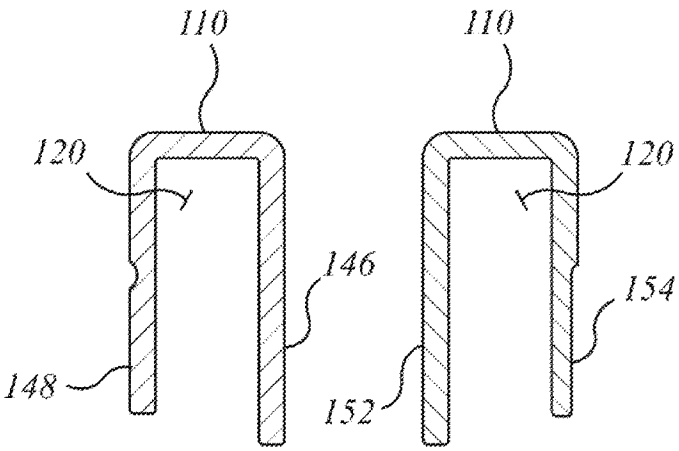
Fig. 3g
Fig. 3f
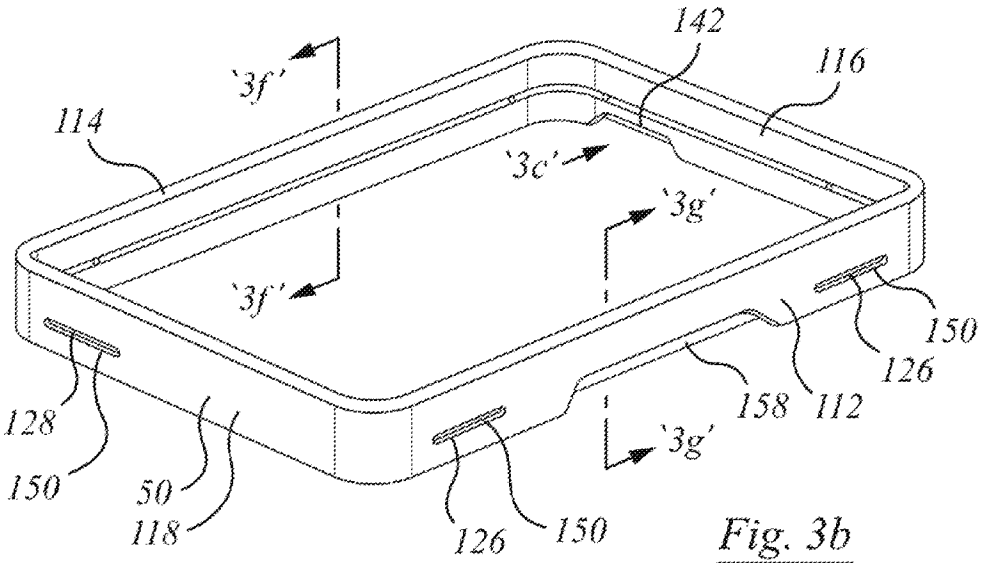
Fig. 3b
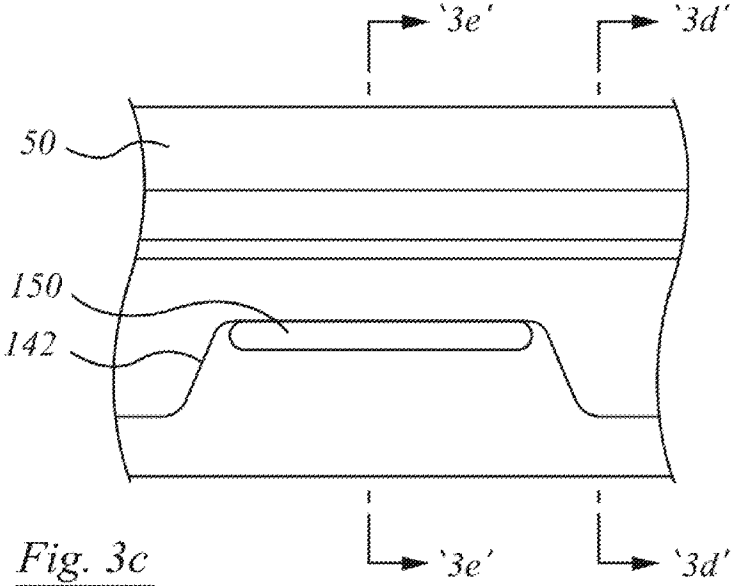
Fig. 3c

FOLDING CONTAINER WITH COVER

FIELD OF THE INVENTION

This invention relates to the field of portable insulated containers.

BACKGROUND OF THE INVENTION

Soft sided insulated containers have become popular for carrying either articles that may best be served cool, such as beverages or salads, or warm, such as appetizers, hot dogs, and so on. Such containers are frequently used to carry liquids, whether hot liquids, such as soup containers, coffee or tea, or cold liquids such as beer, soft drinks, or other carbonated beverages, juices and milk. The containers are typically made in a generally cube-like or rectangular parallelepiped shape, whether of sides of equal length or not, having a base, four upstanding walls, and a top. The top is generally a lid which opens to permit articles to be placed in, or retrieved from, the container.

In soft sided coolers it is common for the closure of the lid to rely on the closing of a zipper, often a zipper running around three sides of a rectangle, with the fourth side being hinged. The lid may rest on a foam lip or pad. When a container of this nature falls over, its resistance to the spilling of liquid through the closure may not be as effective as might be desired. It might be advantageous to have a somewhat tighter seal, such as might be made by stiffer materials in an interference fit. At the same time, while one may desire a friction fit closure for relatively ready and easy use, there are other occasions, such as transport, where a secondary closure or securement may also be desired.

The stiffness desired in a lid, or opening, or friction fit closure may be desirable at the same time as it may also be desirable to have a soft-sided insulated container assembly that can be transformed from an expanded or deployed condition to a collapsed or folded position.

SUMMARY OF THE INVENTION

In an aspect of the invention there is an insulated container assembly. It has a first portion and a second portion co-operable therewith. The first portion has a soft-sided insulated wall structure and a receptacle defined therein. The receptacle has an opening. The second portion is movably connected to the first portion. The first portion has a first closure member that includes a stiffened peripheral frame. The soft-sided insulated wall structure is releasably mounted to the first closure member. The second portion has a second closure member. The second closure member is movable to a first position relative to the first closure member in which the first and second closure members are engaged to obstruct access to the receptable. The first position is a closed position. The second closure member is movable to a second position relative to the first closure member. The second position is an open position that permits access to the receptacle. The first closure member defines a rigid land. The second closure member defines a stiffened member. In the closed position of the second closure member relative to the first closure member the stiffened member is operable to engage the rigid land.

In a feature of that invention, the stiffened member defines a protruding nose and the first closure member is a bezel that defines the land, whereby the nose seats in the bezel when the second closure member is in the closed position relative to the first closure member. In another feature, the rigid peripheral frame defines a surround that includes the land. The soft-sided insulated wall structure has an upper margin. The surround has an accommodation. The upper margin of the soft-sided insulated wall structure seats in the accommodation. In another feature, the second closure member defines a lid of the insulated container assembly. The lid includes a stiffened jamb. In the closed position of the second closure member the door defined by the lid fits within the jamb defined by the surround and engages the land in an interference fit. In a further feature the surround has an inside skirt, and an outside skirt. The land is defined by the inside skirt. When installed the upper margin of the soft-sided insulated wall structure is secured to the outside skirt. In still another feature the outside skirt has at least a first securement fitting to which the upper margin of the soft-sided insulated wall structure is mounted when installed. In another feature the inside skirt has at least a first relief formed therein that provides installation access to the first securement fitting. In still another feature, the soft-sided insulated wall structure has at least a first strap. The first securement fitting is a first aperture formed in the outside skirt. The first strap passes through the first aperture of the first securement fitting on installation, and the first strap folds back upon, and is secured to the soft-sided insulated wall structure. In another feature the inside skirt is spaced from and opposed to the outside skirt and the accommodation is defined therebetween.

In another feature, the second closure member defines a lid of the insulated container assembly. The first closure member is a rigid peripheral frame that defines a surround that includes the land. The surround has an inside skirt, and an outside skirt. The inside skirt is spaced from and opposed to the outside skirt and an accommodation is defined in a downwardly opening channel formed therebetween. The outside skirt has an array of securement apertures spaced thereabout to which a set of straps of the upper margin of the soft-sided insulated wall structure is mounted when installed. The inside skirt has at least a set of reliefs formed therein that provide installation access for the straps to the array of securement fittings. The set of straps pass through the set of apertures on installation, and the set of straps fold back upon, and are secured to the soft-sided insulated wall structure. When installed, the upper margin of the soft-sided insulated wall structure is seated within the accommodation.

In another aspect, there is a soft-sided insulated container assembly. It has a first portion and a second portion co-operable therewith. The first portion having an upstanding soft-sided insulated wall structure that defines a receptacle therewithin, the receptacle having an opening. The second portion is movable relative to the first portion to govern access to the receptacle through the opening. The upstanding soft-sided insulated wall structure including a bottom wall, a front wall, a rear wall, a left-hand side wall and a right-hand side wall. The insulated container assembly is movable between a first position and a second position. In the first position one of (a) the front wall overlies the rear wall; and (b) the rear wall overlies the front wall. In the first position the bottom wall, the right-hand wall and the left hand wall lie between the folded front wall and the folded rear wall. In the second position the upstanding soft-sided insulated wall structure being unfolded to form an open-topped five-sided box.

In a feature of that aspect, at least one of the front wall and the rear wall has a stiffening panel therein. In another feature, both the front wall and the rear wall have stiffening panels therein. In yet another feature, the front wall has a first stiffening panel therein, and the rear wall has a second stiffening panel therein, the first and second stiffening panels being of unequal lengths. In a further feature, the second stiffening panel is longer than the first stiffening panel. In another feature, the receptacle has an opening width measured from the left-hand side wall to the right hand side wall, and an opening depth is measured from the front wall to the rear wall. There is a rear wall height measured from the bottom wall to the opening. The rear wall height is less than the opening depth. In another feature, the lid is hinged to back wall. In another feature the lid is rigid. In another feature, the first portion of the soft-sided insulated container assembly includes a rigid frame defining a surround of the opening of the receptacle. In a further feature, the upstanding soft-sided insulated wall structure is removable detachable from the rigid frame of the surround. In another feature, the rear wall has a handle mounted thereto. In still another feature, the lid has a rigid depending jamb, and when the lid is closed relative to the receptacle the jamb engages the rigid frame in a friction fit. In another feature the assembly has a secondary closure that is engageable when the lid is closed relative to the receptacle. The secondary closure provides additional securement of the lid in the closed position. In another feature, the first portion has at least one securement operable to retain the assembly in the first position.

In another aspect there is a method of folding a soft-sided insulated container assembly, in which the container has a body and a lid, the body defining a receptacle and the lid defining a rigid panel, the body having a bottom wall, a front wall, a rear wall a left-hand side wall, and a right-hand side wall. The method includes folding a first wall of (a) the front wall. and (b) the rear wall to lie against the lid; folding the left-hand side wall and right-hand side wall and the bottom wall next to the one of (a) the front wall. and (b) the rear wall; and folding a second wall of (a) the rear wall and (b) the front wall so that the as-folded left-hand side wall, right-hand side wall, and bottom wall lie between the front wall and the rear wall.

In another feature, the method includes providing a stiffener panel mounted in at least one of (a) the front wall. and (b) the rear wall. In a further feature, the method includes providing the second wall with a stiffening panel, and folding of that panel includes pushing that panel toward the lid with the bottom wall and the left-hand and right-hand wide walls squeezed between the front wall panel and the rear wall panel. In another feature, the method includes providing the first wall with a stiffener panel, and pushing the first wall panel to fold toward the lid. In a further feature, the first wall has a handle mounted thereto, and the method includes using the handle in at least one of (a) folding the first wall toward the lid by pushing with the handle. and (b) unfolding the first wall away from the lid by pulling on the handle. In a further feature, the container assembly has at least one retainer, and, after folding, the method includes securing the second wall in position relative to the lid with the retainer. In another feature, the container assembly includes a rigid frame surround that is releasably secured to the body and that co-operates with the lid, and the retainer is operable to secure the rigid frame surround to the body, and the method of folding includes releasing the retainer and re-securing the retainer after folding. In a further feature, the method includes providing the first wall with a first stiffener panel; providing the second wall with a second stiffener panel, the first stiffener panel being longer than the second stiffener panel, and the method of folding includes folding the first wall with the longer stiffener panel close to the lid, and folding the second wall with the second stiffener panel thereover, further from the lid. In an additional feature, the method includes tugging on said left-hand wall panel and on said right-hand wall panel to draw them apart.

BRIEF DESCRIPTION OF THE DRAWINGS

These aspects and other features of the invention can be understood with the aid of the following illustrations of a number of exemplary, and non-limiting, embodiments of the principles of the invention in which:

FIG. 3*b* is an isometric view of the bezel of FIG. 3*a;*

FIG. 3*c* is an enlarged detail of the bezel of FIG. 3*b* taken on arrow '3*c'*;

FIG. 3*d* is a cross-section of the bezel of FIG. 3*c* on section '3*d*-3*d'*;

FIG. 3*e* is a cross-section of the bezel of FIG. 3*c* on section '3*e*-3*e'*;

FIG. 3*f* is a cross-section of the bezel of FIG. 3*b* on section '3*f*-3*f'*;

FIG. 3*g* is a cross-section of the bezel of FIG. 3*b* on section '3*g*-3*g'*;

DETAILED DESCRIPTION

Figure 1A:
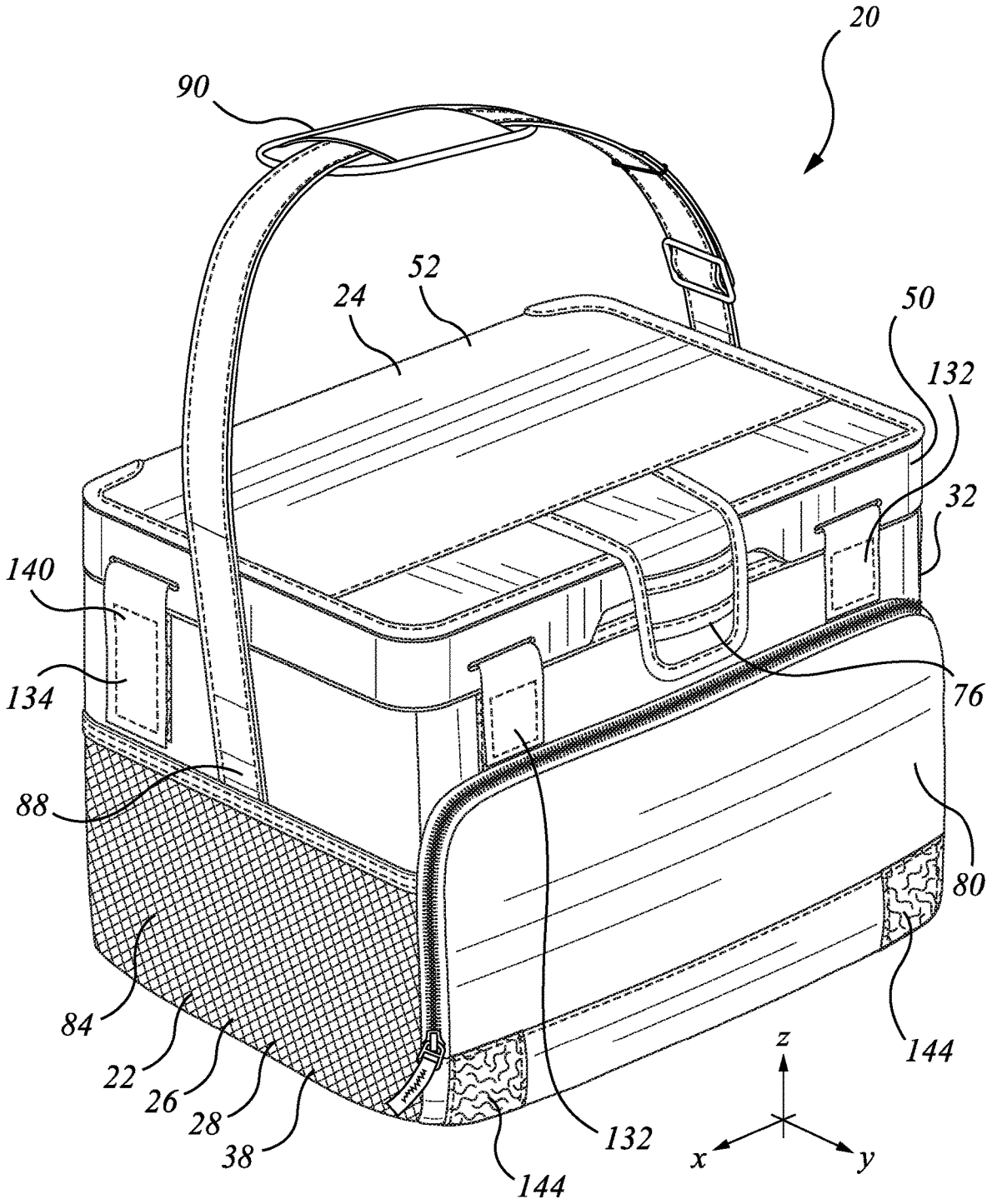
FIG. 1*a* shows an isometric view taken from in front, above, and to the right, of an embodiment of a container assembly according to an aspect of the present invention, the container assembly being in a closed position.

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings are substantially to scale, except where noted otherwise, such as in those instances in which proportions may have been exaggerated in order more clearly to depict certain features of the invention.

For the purposes of this description, it may be that a Cartesian frame of reference may be employed. In such a frame of reference, the long, or largest, dimension of an object may be considered to extend in the direction of the x-axis, the base of the article, where substantially planar, may be considered to extend in an x-y plane, and the height of the article may be measured in the vertical, or z-direction. In other contexts, the z-direction may be the through thickness of a substantially planar panel where the major dimensions lie in the x- and y-directions. The largest container panels herein may be designated arbitrarily as either the front and rear sides, or top and bottom sides, faces, or portions of the container. Similarly, the closure member, or opening is arbitrarily designated as being at the top, and the base panel is designated as being at the bottom, as these terms may be appropriate for the customary orientation in which the objects may usually be found, sold, or employed, notwithstanding that the objects may be picked up and placed on one side or another from time to time at the user's choice.

In the context of the container assembly as a whole, the terms cross-wise, lateral, spanwise, or laterally outboard, or transverse, or transversely outboard refer to a distance or orientation relative to the side-to-side direction, which is typically the x-direction. The commonly used engineering terms "proud", "flush" and "shy" may be used herein to denote items that, respectively, protrude beyond an adjacent element, are level with an adjacent element, or do not extend as far as an adjacent element, the terms corresponding conceptually to the conditions of "greater than", "equal to" and "less than".

It should also be understood that, within the normal range of temperatures to which human food and human touch is accustomed, although the term cooler, or cooler container, or cooler bag, may be used, such insulated structures may generally also be used to aid in keeping food, beverages, or other objects either warm or hot as well as cool, cold, or frozen.

In this specification reference is made to insulated containers. The adjective "insulated" is intended to be given its usual and normal meaning as understood by persons skilled in the art. It is not intended to encompass single layers, or skins, of conventional webbing materials, such as Nylon (™), woven polyester, canvas, cotton, burlap, leather, paper and so on, that are not otherwise indicated as having, or being relied upon to have, particular properties as effective thermal insulators other than in the context of being provided with heat transfer resistant materials or features beyond that of the ordinary sheet materials in and of themselves. Following from Phillips v. AWH Corp., this definition provided herein is intended to supplant any dictionary definition, and to prevent interpretation in the US Patent Office (or any other Patent Office) that strays from the customary and ordinary meaning of the term "insulated". The Applicant also explicitly excludes cellophane, waxed paper, tin foil, paper, or other single use disposable (i.e., not intended to be re-used) materials from the definition of "washable".

Similarly, this description may tend to distinguish various embodiments of hard shell containers from soft-sided containers. In the jargon of the trade, a soft-sided cooler, or bag, or container, is one that does not have a substantially rigid, high density exoskeleton. A typical example of a container having a hard exoskeleton is one having a molded shell, e.g., of ABS or polyethylene, or other common types of molded plastic. Rather, a soft-sided container may tend not to be substantially rigid, but may rather have a skin that is flexible, or crushable, or sometimes foldable. By way of an example, which is not intended to be exhaustive, comprehensive, exclusive or limiting, a soft-sided cooler may have an outer skin, a layer of insulation, and an internal skin, both the internal and external skins being of some kind of webbing, be it a woven fabric, a nylon sheet, or some other membrane. The layer of insulation, which may be a sandwich of various components, is typically a flexible or resilient layer, perhaps of a relatively soft and flexible foam. In some examples, a soft-sided container may include a substantially rigid liner, or may include one or more battens (which may be of a relatively hard plastic) concealed within the soft sided wall structure more generally, or where hard molded fittings may be used either at a container rim or lip, or to provided a base or a mounting point for wheels, but where the outside of the assembly is predominantly of soft-sided panels. Once again, this commentary is intended to forestall the adoption by the US Patent Office, (or any other Patent Office), of an interpretation of the term "soft-sided" that diverges from the ordinary and customary meaning of the term as understood by persons of ordinary skill in the art in the industry, and as used herein.

Figure 1B:
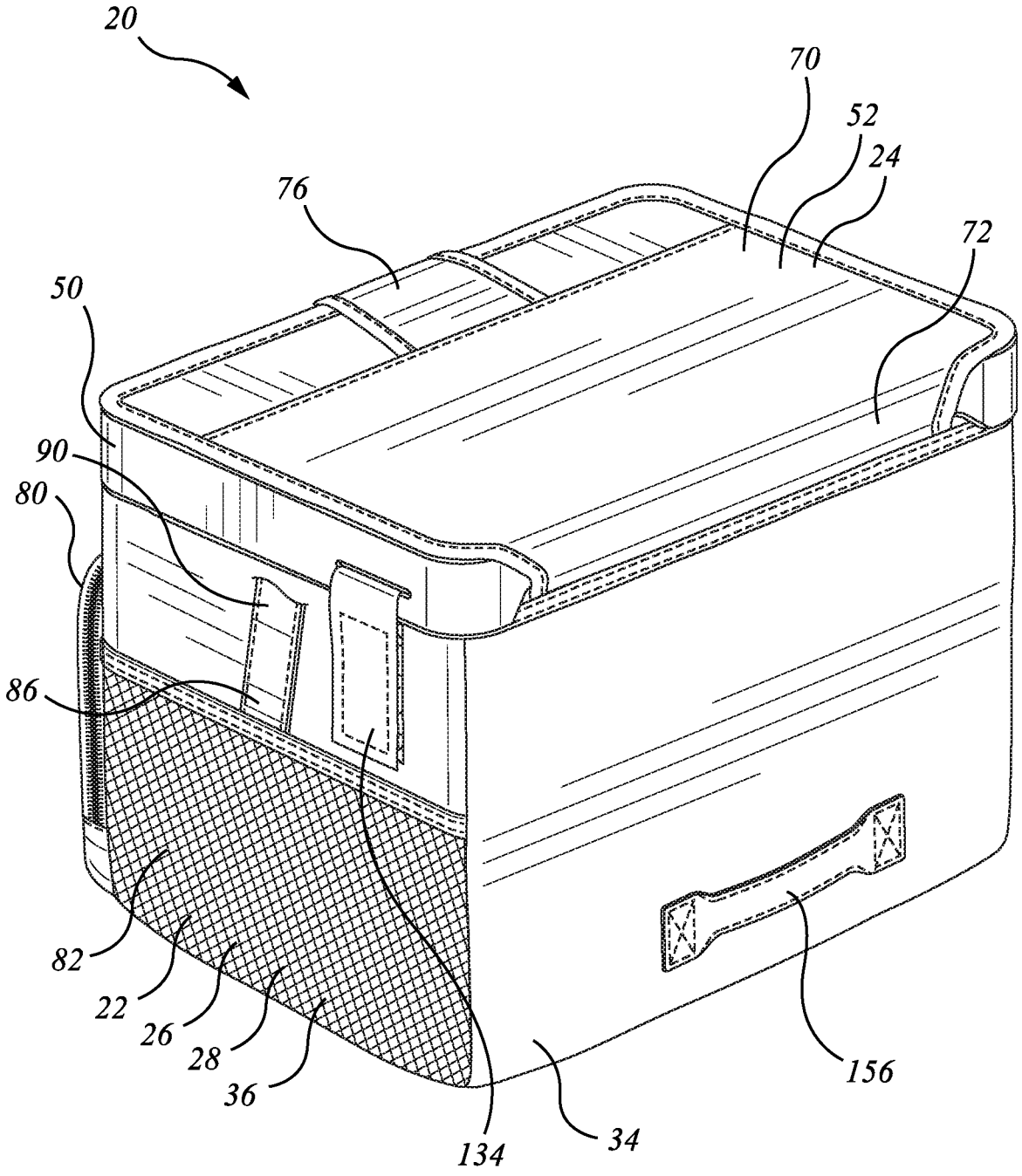
FIG. 1*b* shows an isometric view taken from in behind, above, and to the left, of the container assembly of FIG. 1*a;*
Figure 1C:
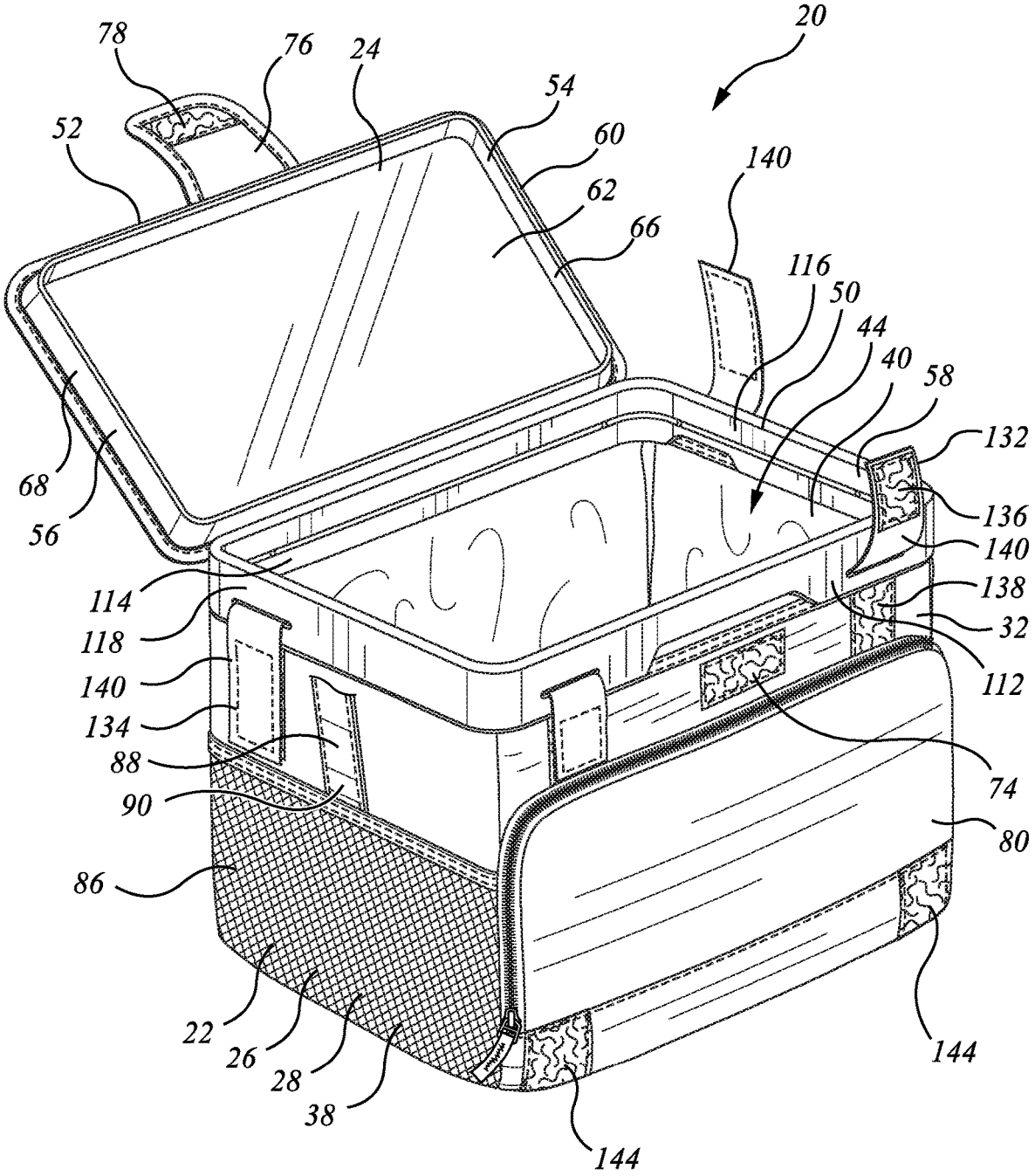
FIG. 1*c* shows an isometric view taken from in front, above, and to the right, of the container assembly of FIG. 1*a* in an open position.
Figure 1D:
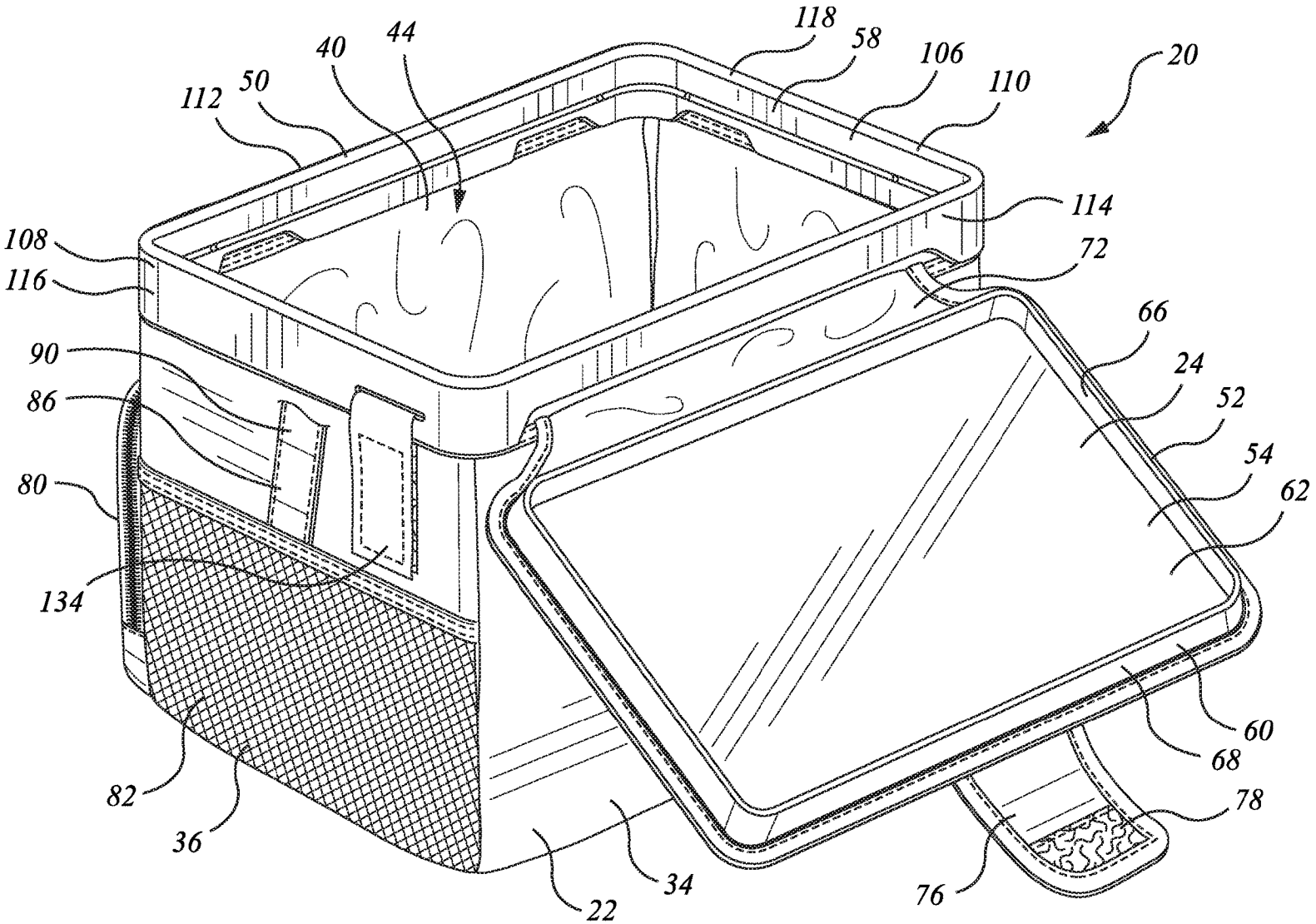
FIG. 1*d* shows an isometric view taken from in behind, above, and to the left, of the container assembly of FIG. 1*b* in the open position.

Referring to FIGS. 1*a*, 1*b*, 1*c* and 1*d*, and by way of a general overview, a container assembly is indicated generally as 20. Container assembly 20 is a soft-sided insulated container assembly. Container assembly 20 has a first, or main portion 22, and a second portion 24. Second portion 24 is mounted to first portion 22 and is movable relative thereto between a first position and a second position to govern access to container assembly 20. The first position, seen in FIGS. 1*a* and 1*b* is a closed position. The second position, seen in FIGS. 1*c* and 1*d* is an open position.

Main portion 22 includes an outer casing 26 in the nature of a soft-sided, insulated wall structure 28. In the example shown, outer casing 26 has a bottom wall 30, a front wall 32, a rear wall 34, a left-hand side wall 36, and a right-hand side wall 38. Bottom wall 30 and side walls 32, 34, 36 and 38 co-operate to form an upstanding open-topped five-sided box. A receptacle 40 is defined within soft-sided insulated wall structure 28. Receptacle 40 may be watertight. Receptacle 40 does not include a rigid liner, and is foldable. Main portion 22 also has a rigid member in the form of a ring-frame, or open from, or peripheral stiffener or a surround, or rim, or rim-reinforcement, however it may be called, that is identified in the drawings as bezel 50. It may also be termed "surround 50" or "frame 50" in this specification, the terminology being interchangeable for the purposes of this description. Frame 50 and upstanding soft-sided wall structure 28 are co-operably mated together. Frame 50 is removably secured to the upper margin of upstanding soft-sided wall structure 28, as explained in greater detail below. The feature of removability permits wall structure 28 to be separated from frame 50 from time to time to facilitate washing of wall structure 28 separately from frame 50.

Wall structure 28 has an upper portion or upper rim 42 that extends peripherally about the top of receptacle 40. Rim 42 is made by the collective co-operation of the upper margins of all of the upstanding walls 32, 34, 36 and 38. Rim 42 mates with frame 50, which also runs peripherally about the top margin of wall structure 28. The opening defined within rim 42, and through frame 50, is identified as receptacle opening 44. As may be understood, objects may be placed in, or removed from receptacle 40 through opening 44 according to the position of second portion 24 relative to first portion 22, i.e., when second portion 24 is in the first, or closed position relative to first portion 22, access to the chamber defined inside receptacle 40 is obstructed, and when second portion 24 is in the second, or open, position access to the chamber inside receptacle 40 is permitted rather than obstructed.

Second portion 24 of container assembly 20 is indicated as a top panel, or lid assembly identified as lid 52. Lid 52 has an internal structural member 54 for engagement with frame 50. In this context, frame 50 acts as a first closure member. Lid 52 acts as the second or mating closure member that co-operates with the first closure member to govern access to the enclosed chamber defined within receptacle 40. Internal structural member 54 may have a peripherally extending bead or seal member 56 for interferingly engaging the mouth of receptacle 40, in particular it engages the land 58 defined by the inside face of frame 50. The interference fit of lid 52 as such may tend to deter the egress of materials, that might otherwise occur when container assembly 20 is inadvertently tipped over or jostled excessively energetically.

Internal structural member 54 has a peripherally extending structural section 60 that is sized to fit within, and to mate with, frame 50. Internal structural member 54 may be an open frame, like a banjo frame, over which an external skin of fabric, or an insulated blanket of fabric may be sewn or stretched. In the example shown, however, internal structural member 54 includes a spanning member 62 that defines a continuous web within the periphery surrounding wall defined by structural section 60. Structural section 60 forms a flange around spanning member 62. It has an inside leg 66 and an outside leg 68. Outside leg 68 has an outwardly rolled edge. An insulated panel 70 overlies internal structural member 54, and thereby insulates lid 52. Although insulation may be provided in soft quilts, in the example shown the insulation is a relatively stiff expanded foam pad that is stiff enough to support objects placed upon lid 52. Second portion 24, and so lid 52, is connected to first portion 22 by a hinge 72. Hinge 72 is secured at the top to the rear margin of lid 52, and at its lower edge to the upper margin of rear wall 34. Hinge 72 may be a fabric hinge, as shown. In use, the downwardly depending structural section 60 defines a nose or nosing, or a plug, or a male member, that seats within the receiver, or seat or socket defined by frame 50. Structural section 60 is then like a door or striker plate that interacts with a door jamb defined by frame 50. The relationship between this nosing or plug and the land of frame 50 is the same as that of a pane within a bezel, in which frame 50 defines the bezel, or seat, for the lid structure. In the embodiment illustrated, structural section 60 and spanning member 62 are formed as a unitary rigid plastic molding.

The interference friction fit of the engagement of internal structural member 54 with land 58 of frame 50 defines a first closure of soft-sided insulated container assembly 20. Additionally there is a secondary closure, or secondary securement. To that end, first portion 22 has a first member of the second securement in the form of a hook-and-eye fabric strip or pad 74 located on the front face of front wall 32, below the lower edge of frame 50; second portion 24 has a second member of the second securement in the form of a flap or latch 76 that has a root mounted to lid 52, and a distal tongue that has a mating hook-and-eye patch 78 that co-operatively mates with patch 74 when closed and secured. To some extent it is arbitrary whether pad 74 is mounted to first portion 22 or second portion 24 or flap or latch 76 is mounted to second portion 24 or first portion 22. Different kinds of mating male and female latch combinations could be used, whether with snaps, magnets, rotating fasteners, clips or such releasable fasteners as may be.

First portion 22 may also provide the basic supporting structure to which auxiliary features are mounted, notably a secondary enclosure or pouch 80 mounted on the front of front wall 32, and pockets 82 and 84 mounted on the end walls, i.e., on left-hand side wall 36 and right-hand sidewall 38. Soft-sided container assembly 20 also has a lifting apparatus in the form of a handle or carrying strap 90 that has a first end 86 mounted to left-hand side wall 36 and a second end 88 mounted to right-hand side wall 38.

Figure 2D:
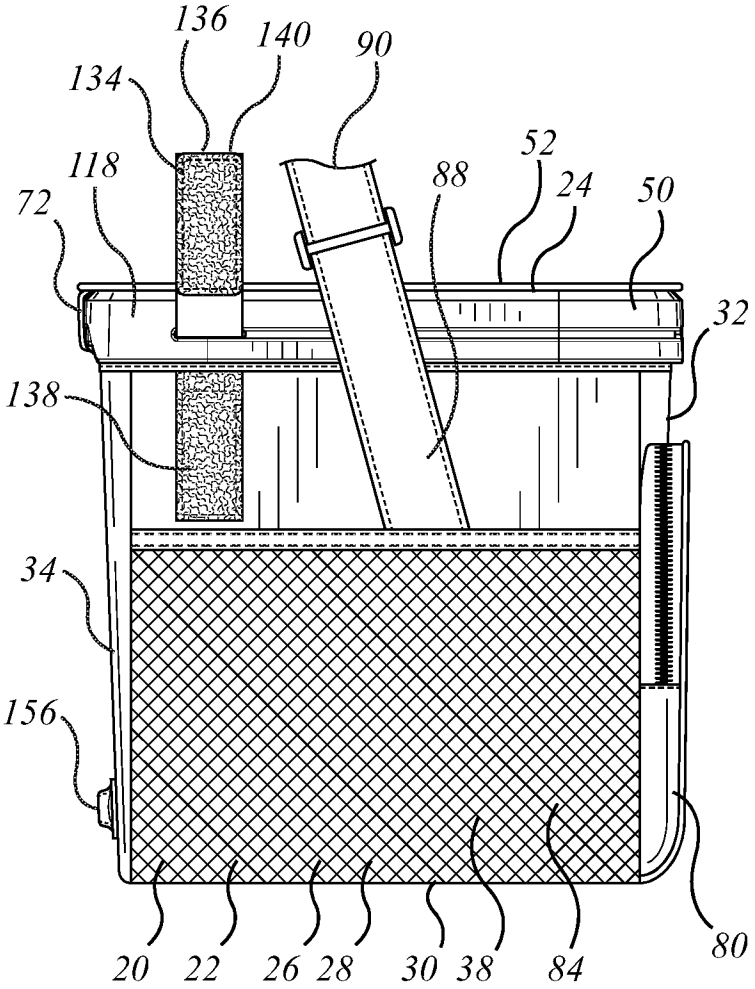
FIG. 2*d* is a right-hand side view of the container assembly of FIG. 2*a;*
Figure 2A:
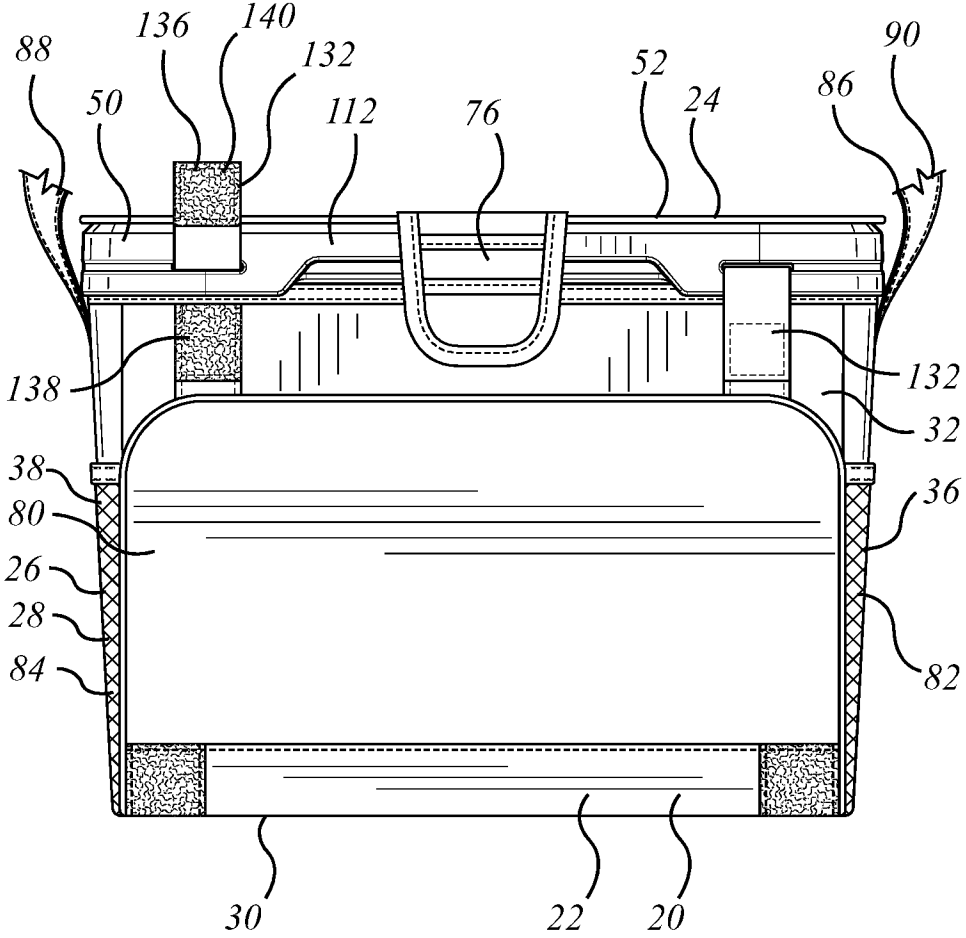
FIG. 2*a* is an orthogonal front view of the container assembly of FIG. 1*a;*
Figure 2C:
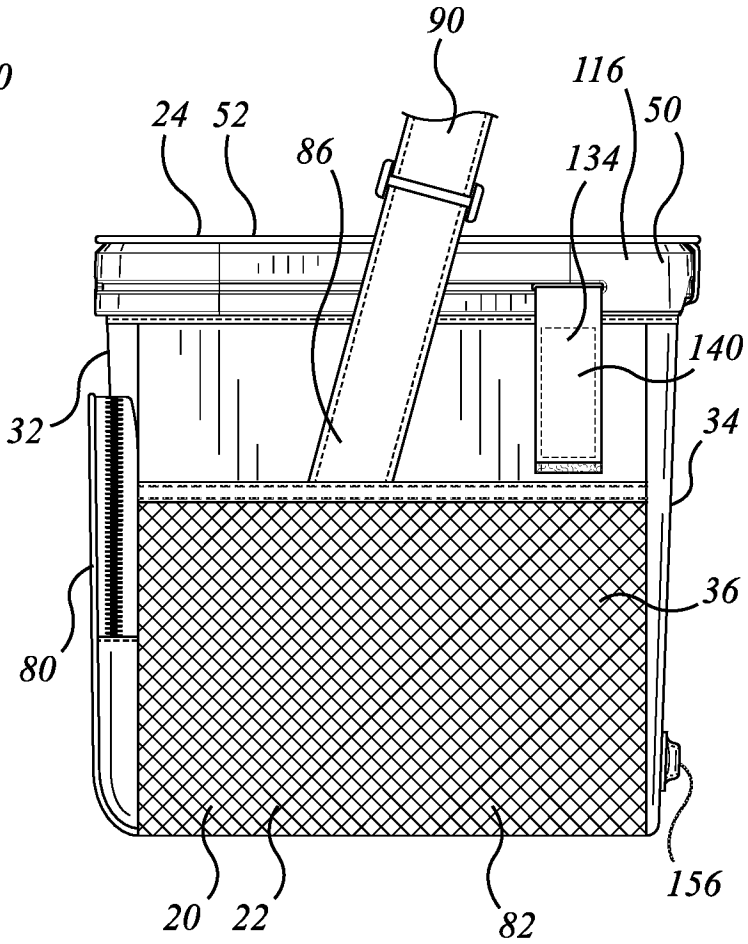
FIG. 2*c* is a left-hand side view of the container assembly of FIG. 2*a*
Figure 2B:
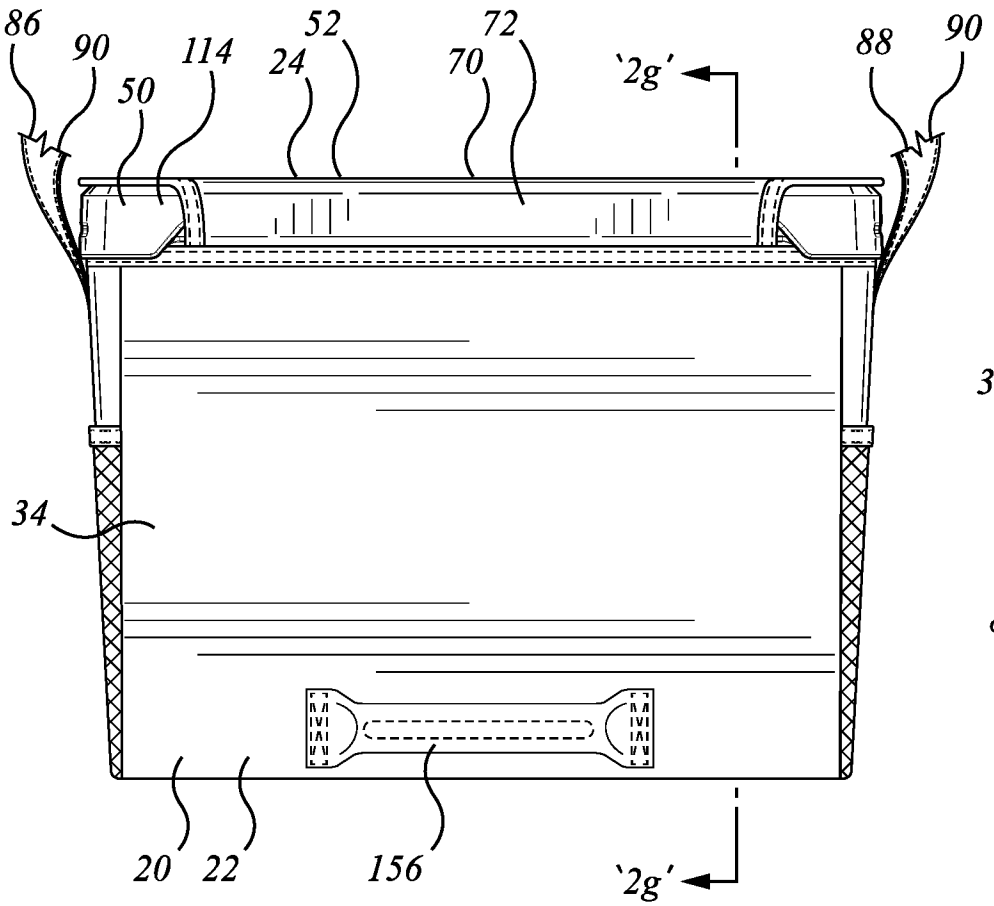
FIG. 2*b* is a rear view of the container assembly of FIG. 2*a ;*
Figure 2E:
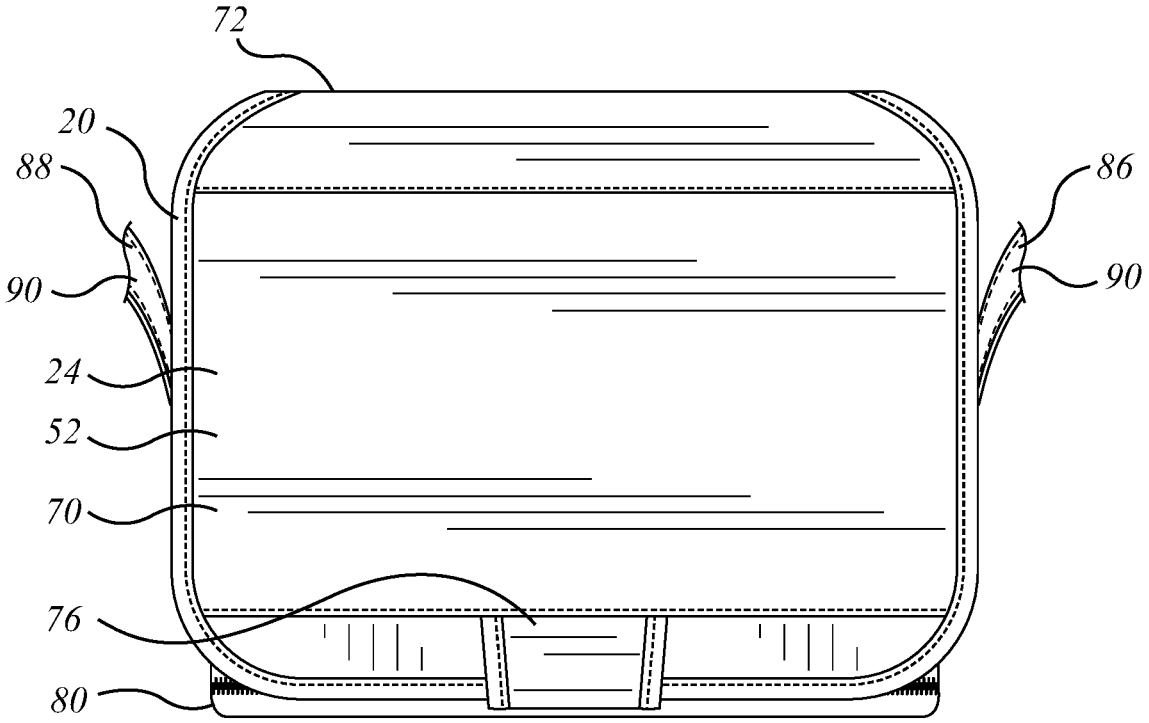
FIG. 2*e* is a top view of the container assembly of FIG. 2*a;*
Figure 2F:
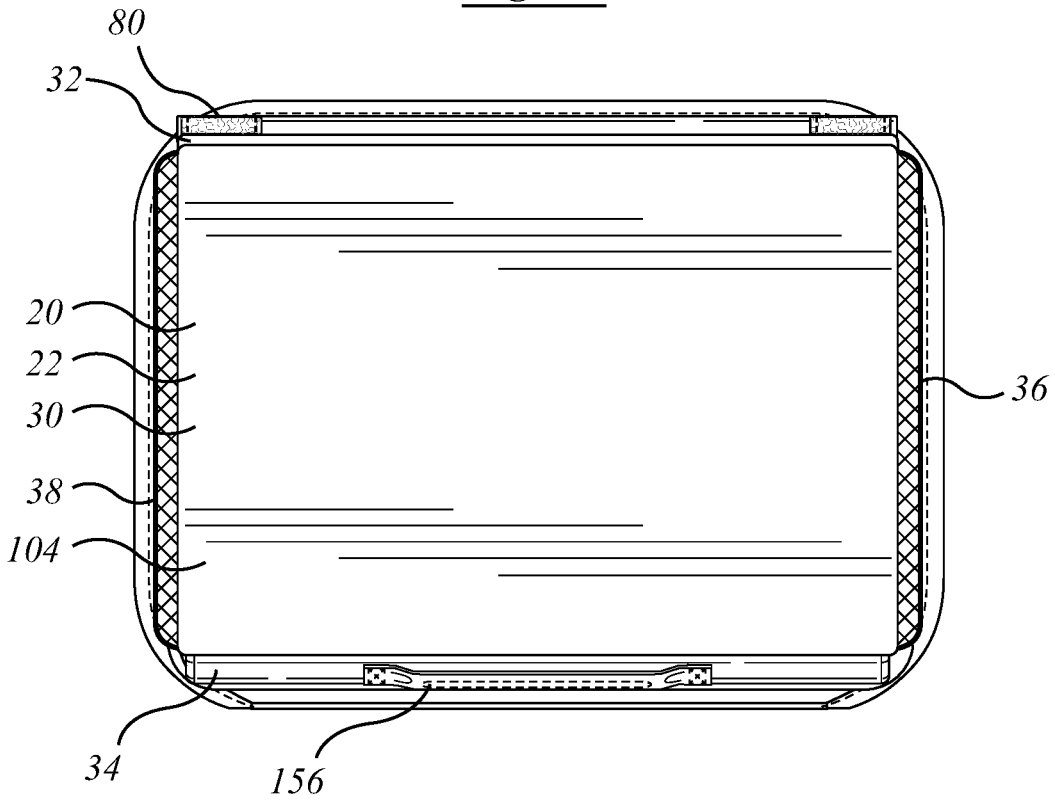
FIG. 2*f* is a bottom view of the container assembly of FIG. 2*a;*
Figure 2G:
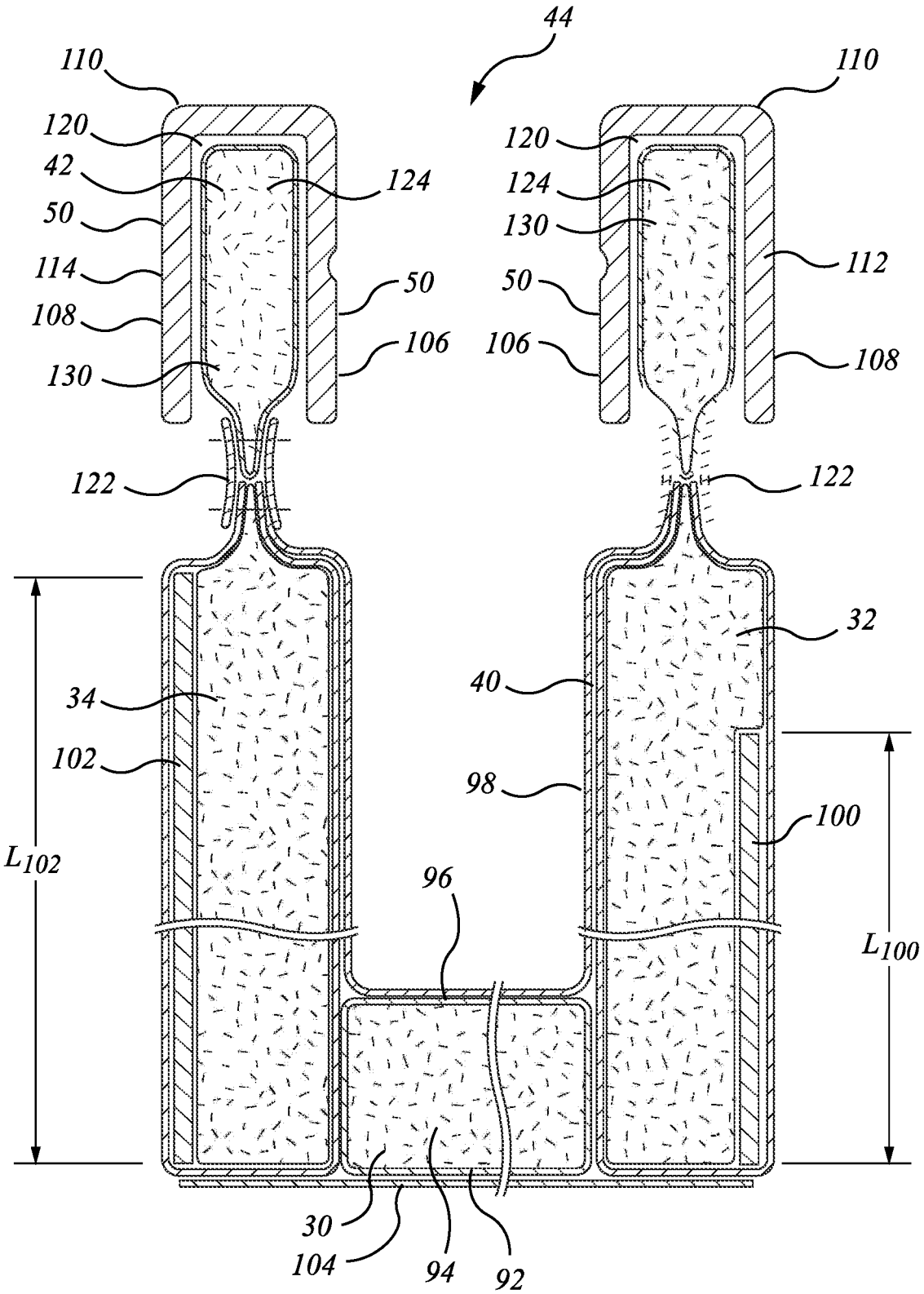
FIG. 2*g* is a cross-section of the lower portion of the container assembly of FIG. 1*a* with the front pouch omitted.

The structure of walls 30, 32, 34 can be understood from the sectional view of FIG. 2*g*. In respect of FIG. 2*g*, the external auxiliary features such as pouch 80 are omitted. Considering first front wall 32, it can be seen there is an external or outside skin 92 that may typically be made of a relatively durable and scuff-resistant woven polymer. Inwardly of outside skin 92 is a flexible layer of thermal insulation 94, such as may be a closed cell foam. There may be a first inside skin or layer 96, which may be a laminated metallicized PET sheet, and there may be a further interior skin or layer in the form of a transparent liner 98. Effectively items 96 and 98 can be provided in a single laminated web.

Figure 2H:
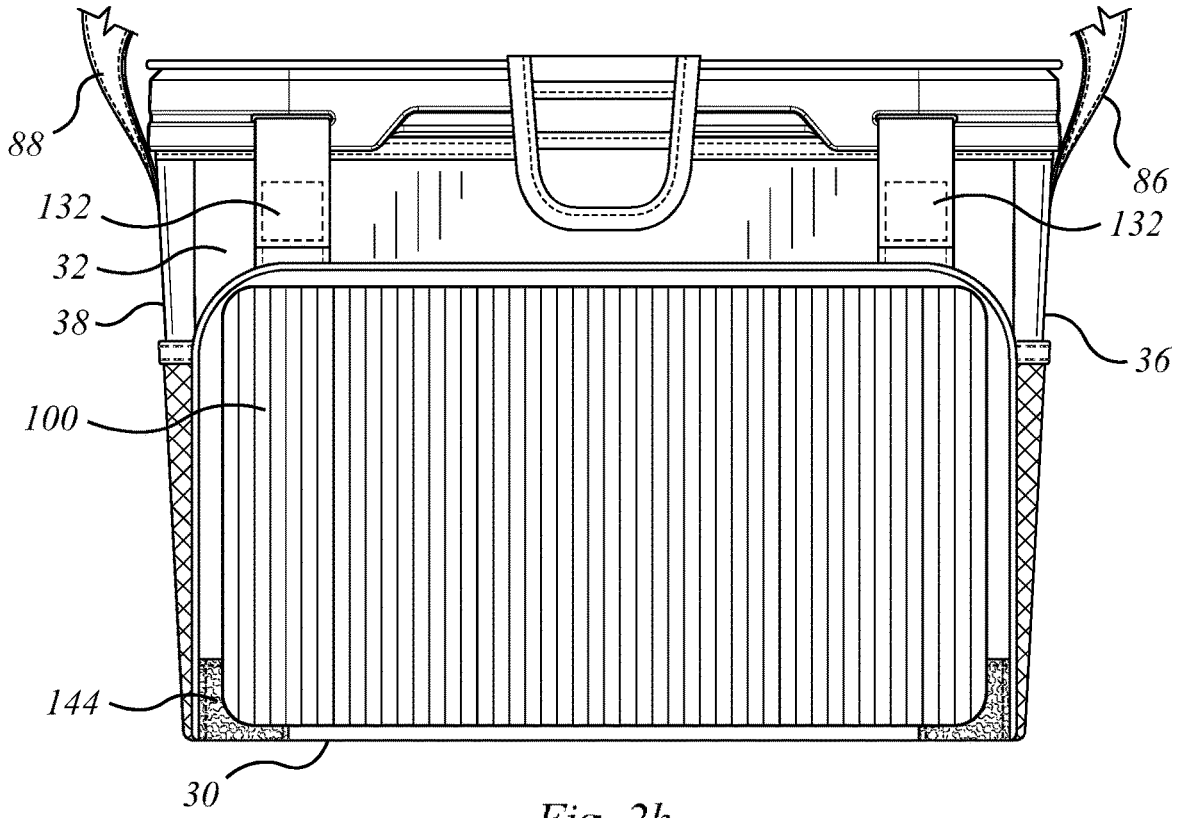
FIG. 2*h* is a front view of the container assembly of FIG. 2*a* with the internal front wall stiffener superposed to show its relative size and location.
Figure 2I:
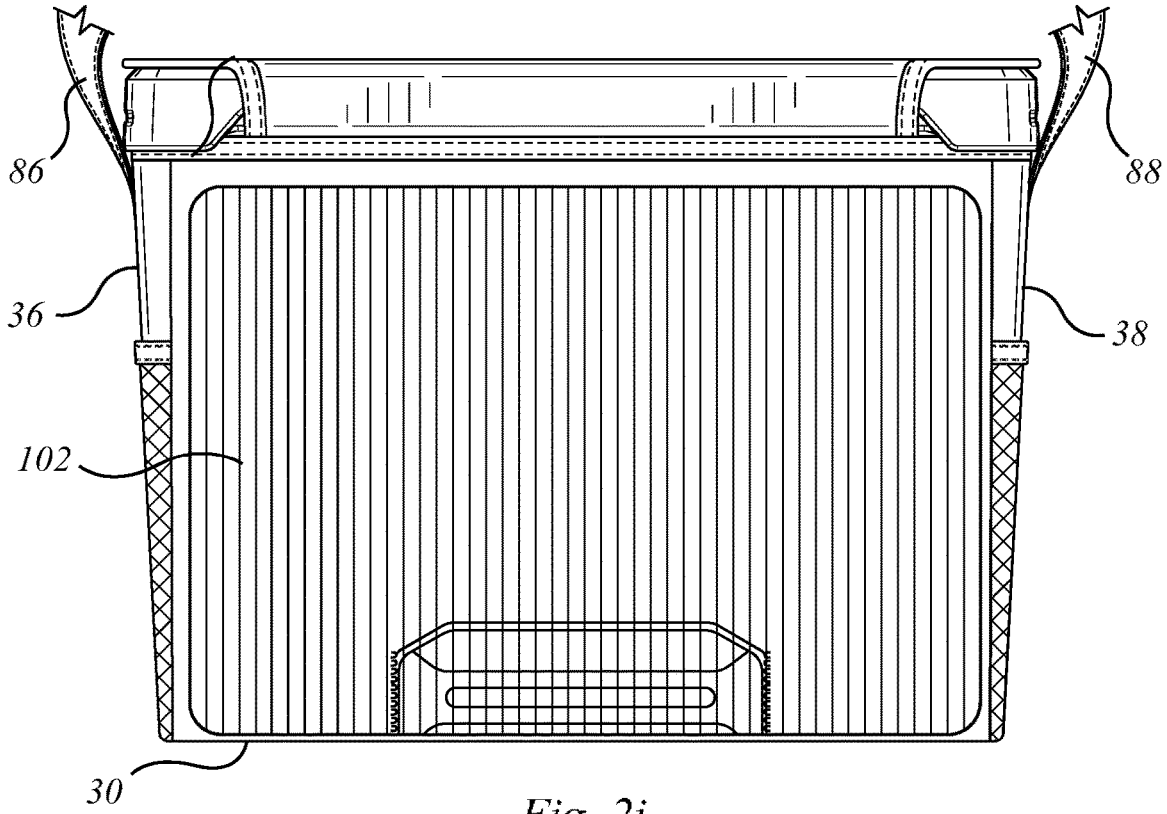
FIG. 2*i* is a rear view of the container assembly of FIG. 2*a* with the internal rear wall superposed to show its relative size and location.

Additionally, front wall 32 may have a reinforcement, or batten, or stiffened panel 100. It lies inwardly of external skin 92. In the example illustrated it lies between the external skin and the insulation. Stiffened panel 100 is sewn within a pair of non-woven polypropylene sheets that are then sewn at their margins into the structure of front wall 32 more generally. Stiffened panel 100 is sized to correspond to the width of front wall 32 in the x-direction, and has a length $L_{100}$ that corresponds to a distance in the z-direction that is less than the height of front wall 32 by roughly double the wall thickness of front wall 32. (The thicknesses shown in FIG. 2*g* are not to scale). The remaining height above the end of stiffened panel 100 permits that portion of front wall 32 to bend and fold over rear wall 34 when container assembly 20 is folded. FIGS. 2*h* and 2*i*, show the placement and size of stiffener panels 100 and 102 relative to the walls in which they are mounted.

Similarly, rear wall 34 has the same construction as front wall 32, other than that rear wall 34 has a stiffened panel 102 that is sized to fit the width of rear wall 34 in the x-direction, and a length in the z-direction $L_{102}$ that is sized to fit the overall height of rear wall 34. It may be noted that $L_{102}$ is longer than $L_{100}$. It may also be noted that $L_{102}$ is less than, or may generally correspond to, the depth in the y-direction of lid assembly 32 and frame 50. In terms of folding, the junction of rear wall 34 with the rear margin of frame 50 forms a pivot, or hinge, at which rear wall 34 is capable of folding forwardly to lie against or behind, second portion 24.

Left-hand side wall 36 and right-hand side wall 38 may have the same or substantially the same construction as front wall 32 or rear wall 34, but they do not include stiffeners such as 100 or 102. However, the ends 86 and 88 of carrying strap 90 are secured to side walls 36 and 38 as noted above. Bottom wall 30 may have, and in the embodiment illustrated does have, the same construction as side walls 36 and 38. Bottom wall 30 does not include a rigid stiffener like stiffeners 100 or 102. Bottom wall 30 may have an external skin, or layer, or protector, such as identified by scuff-resistant covering 104, which may be a relatively heavy fabric or other suitable material to protect the bottom of the container which may be expected to sit on the ground in use.

Figure 3A:
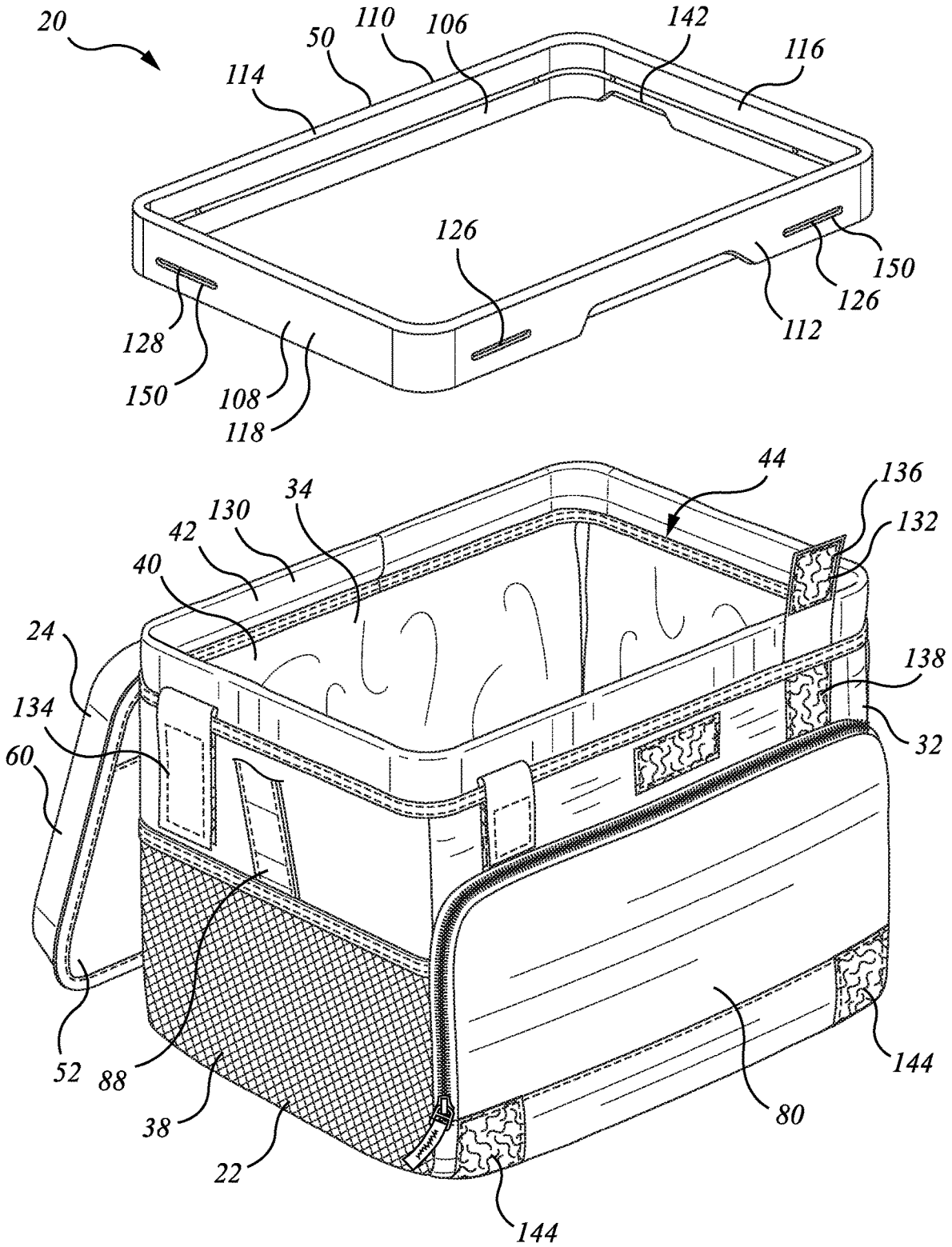
FIG. 3*a* shows the container assembly of FIG. 2*a* with its container body mounting bezel separated from the lower portion of the container.

Looking at frame 50 in greater detail, it can be seen in FIG. 3*a* that frame 50 extends circumferentially or peripherally about the upper margin of the upstanding soft-sided insulated sidewall of wall structure 28. It has corresponding first, second, third, and fourth portions identified as front, rear, left-hand and right-hand portions 112, 114, 116 and 118 respectively, that co-operate to form a continuous peripheral structure. The basic form of the section is shown in FIG. 3*d*. There is an inside skirt or inside leg 106 and an outside skirt or outside leg 108 joined by a back 110 to form a downwardly opening channel section that defines an accommodation 120 between legs 106 and 108. As a channel section, frame 50 is relatively stiff. Frame 50 may be made of a variety of stiff materials. It may be, and in the embodiment illustrated it is, a rigid plastic molding. Although FIG. 3*d* shows legs 106 and 108 as being parallel, they may be splayed or tapered such that the tips of legs 106 and 108 are farther apart than the roots at back 100 to provide a molding draft angle for manufacture. Legs 106 and 108 need not be of the same length, and in the embodiment illustrated they are of different lengths, the inside leg being shorter than the outside leg.

Accommodation 120 is sized to receive the upper band 130 of the rim or upper margin of soft-sided insulated wall structure 28. Upper band 130 is a continuous band. It is sewn to the respective upper portions of walls 32, 36, 34 and 38 around the opening 44, at a double seam 122. Band 130 has a height in the vertical direction that corresponds to the height of accommodation 120. Band 130 is filled with insulation 124 to give a through-thickness that corresponds to the inside width of accommodation 120. In the example illustrated, the outside width of the section of frame 50 corresponds, roughly, to the outside through-thickness of walls 32, 34, 36 and 38. Accordingly, in that embodiment the through thickness of upper band 130 is correspondingly thinner. Being filled with insulating foam, on installation band 130 is squeezed or modestly compressed when inserted between legs 106, 108. It is not loose, but in a friction fit.

The cross-section of FIG. 3*e* is taken at the location of the various openings formed in frame 50. That is, as noted above, soft-sided insulated wall structure 28 is removably mounted to frame 50. To that end, soft sided-insulated wall structure 28 has a set of attachment fittings 140 that are spaced about the periphery of frame 50. In the example shown there are four such fittings, although there could be more, as suitable. In the example shown, there are left-hand and right-hand front wall attachment fittings in the form of straps 132, and left-hand and right-hand side wall attachment fittings in the form of straps 134. The roots of straps 132 are attached to front wall 32; the roots of straps 134 are attached to side walls 36 and 38 respectively, such that there is a four-point attachment pattern. Similarly, frame 50 has a corresponding set of securement fittings 150 that are engaged by the attachment fittings 140. In the example illustrated, securement fittings have the form of accommodations, or apertures, or slots, identified as openings 126 in front portion 112 of frame 50, and openings 128 in left portion 116 and right portion 118 of frame 50. In use, straps 132, 134 pass through openings 126, 128, respectively, and are folded back upon themselves. The inside face of the distal tip of the tongue of the straps has a hook-and-eye fabric fastener patch 136 that then engages a mating hook-and-eye fabric fastener patch 138 on the outside of the respective strap. The return securement patch need not be part of the strap but could be mounted to the respective wall of the container. However, it is convenient that it be located on the root of the strap. Hook-and-eye fabric fasteners could alternatively have the form of ties or snaps, or clips, as may be. Finally, additional hook-and-eye fabric patches 144 are also mounted on front wall 32, (or where there is a secondary compartment mounted to front wall 32, then to that secondary compartment) at the corner distant from frame 50, at the vertices where front wall 32 meets side walls 36 and 38 respectively. Patches 144 are engaged by patches 136 of straps 134 when container assembly 20 is in the folded position. Additionally, there is a grip or handle 156 mounted to rear wall 34. In the example shown, handle is mounted at or near the base of rear wall 34 distant from frame 50.

Inasmuch as the tongue of the respective straps is to be fed through openings 126, 128, at the locations of openings 126, 128 the inside leg 106 of frame 50 is relieved at those locations, the respective reliefs being indicated as 142, the relief having the form of an upwardly extending rebate that extends to the height of openings 126, 128, such that the ends of straps 132, 134 can then be fed horizontally through openings 126, 128.

FIG. 3*f* shows the cross-section of frame 50 along the rear edge where the section is substantially the same as in FIG. 3*d*, except that both inside leg 146 and outside leg 148 are shorter than legs 106 and 108 with the inside leg again being slightly longer. The shorter legs can be used given that the rear run of frame 50 is unperforated. Similarly, FIG. 3*g* shows the section of frame 50 along the central part of the front 112 again has shorter legs 152, 154 of which the inside leg 152 is slightly longer, and the outside leg is of reduced section. In this case, the shortness in the region of central rebate 158 permits latch 76 to be secured a bit higher on the front face of front wall 32 than if the outside skirt were longer, as in skirt or leg 108. In other embodiments the front edge central portion may be flush with the adjacent longer skirt as in legs 106, without the central rebate 158.

Figure 3H:
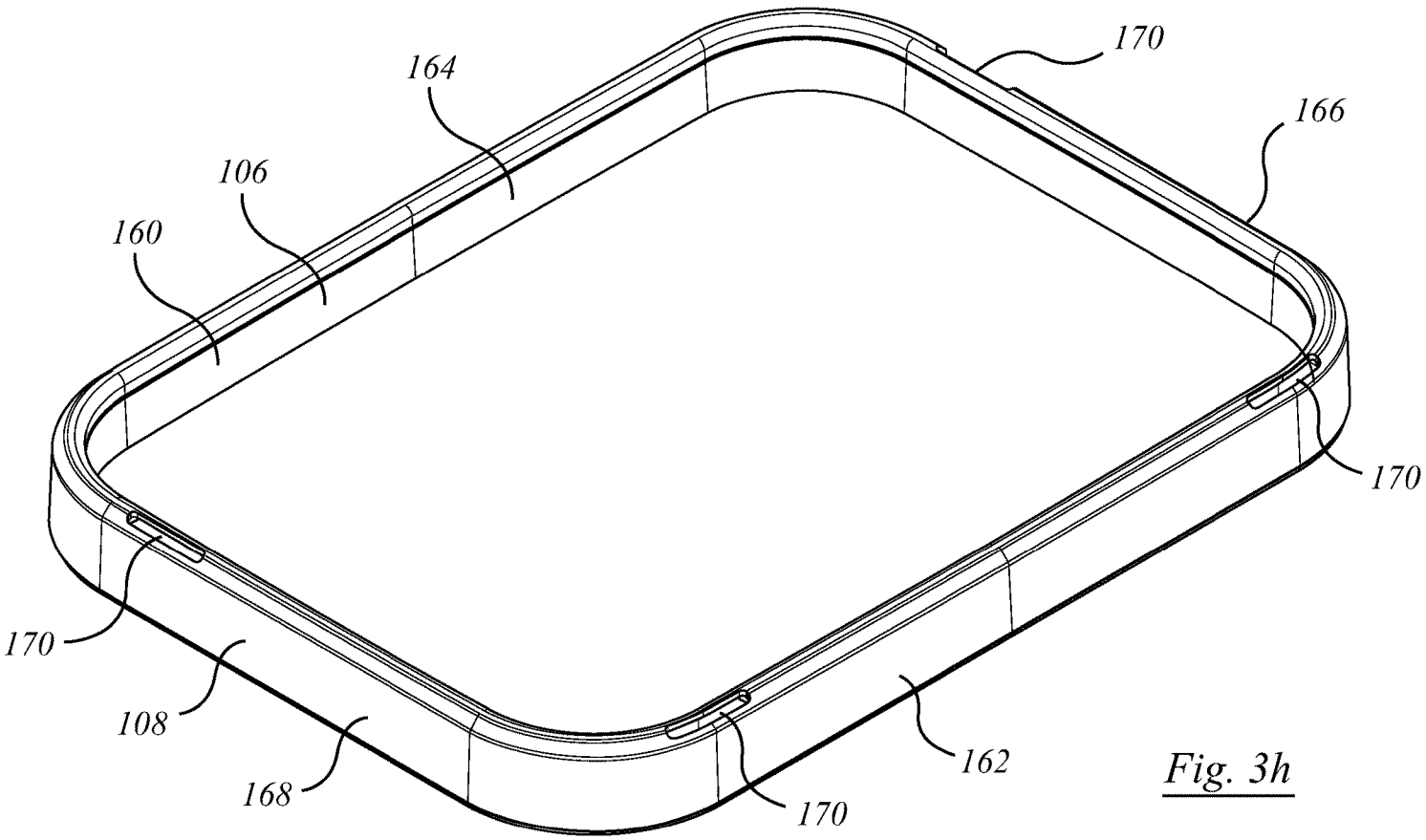
FIG. 3*h* is an isometric view of an alternative bezel to that of FIG. 3*b;*
Figure 3I:
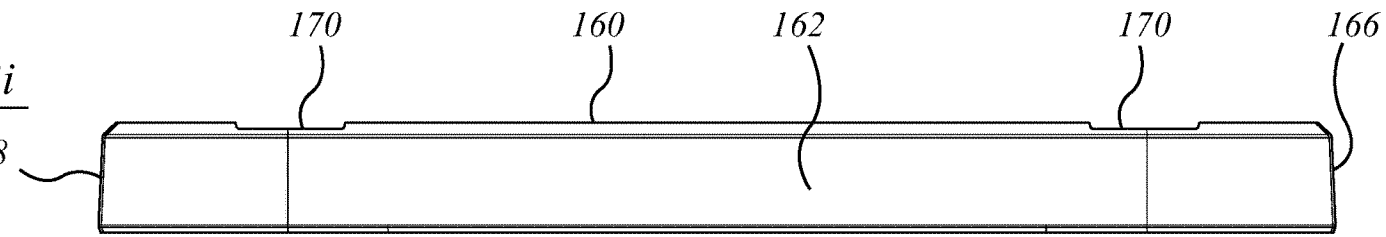
FIG. 3*i* is a front view of the bezel of FIG. 3*h;*

FIGS. 3*h* and 3*i* there is an alternate form of bezel or ring-frame shown as frame 160. Frame 160 may be taken as being the same as frame 50 except that frame 160 does not have openings 126 and 128 in front portion 112 and left-hand and right-hand portions 116, 118, with the corresponding reliefs 142 located to permit the securement straps 132 and 134 of attachment fittings 140 to be fed laterally through openings 126 and 128 respectively. Instead, frame 160 has front, rear, left-hand and right-hand portions 162, 164, 166 and 168. Portions 162, 166 and 168 have respective openings 170 formed in back 110, along the apex of spine of back 110. Relief 142 is not then provided, and the legs of the section are full-length legs 106 and 108, giving the full depth of section. Moreover, the full-length legs continue along the front portion as well, such that rebate 158 in front portion 112 has been eliminated. As may be appreciated from FIG. 3*i*, openings 170 have an edge that lies slightly lower than the apex of back 110 more generally. When straps 132 and 134 are fed upwardly through openings 170, they are then folded outwardly, and back on themselves as before such that pads 138 and 136 are then engaged to secure frame 160.

In some products, it may be desirable to be able to collapse or fold the soft-sided insulated container into a more compact form, as for shipping or storage, yet to be able to expand the container to an unfolded, or expanded, or deployed condition for normal use. At the same time, it may also be desirable to have a container that has a friction fit closure, or a sealed closure, or a rigid opening geometry that will keep its shape to facilitate placing objects in, or retrieving object from, the container. Or, alternatively, it may be desired to have a rigid lid, while nonetheless retaining the ability to fold or collapse the overall structure to a smaller volume. At the same times, where a rigid liner is employed, the container is not collapsible because the rigid liner is not collapsible. By contrast, a rigid container rim frame, such as frame 50, may tend to provide the rigidity suitable for one or all of these purposes, while still permitting folding of the structure to a smaller condition.

Figure 4A:
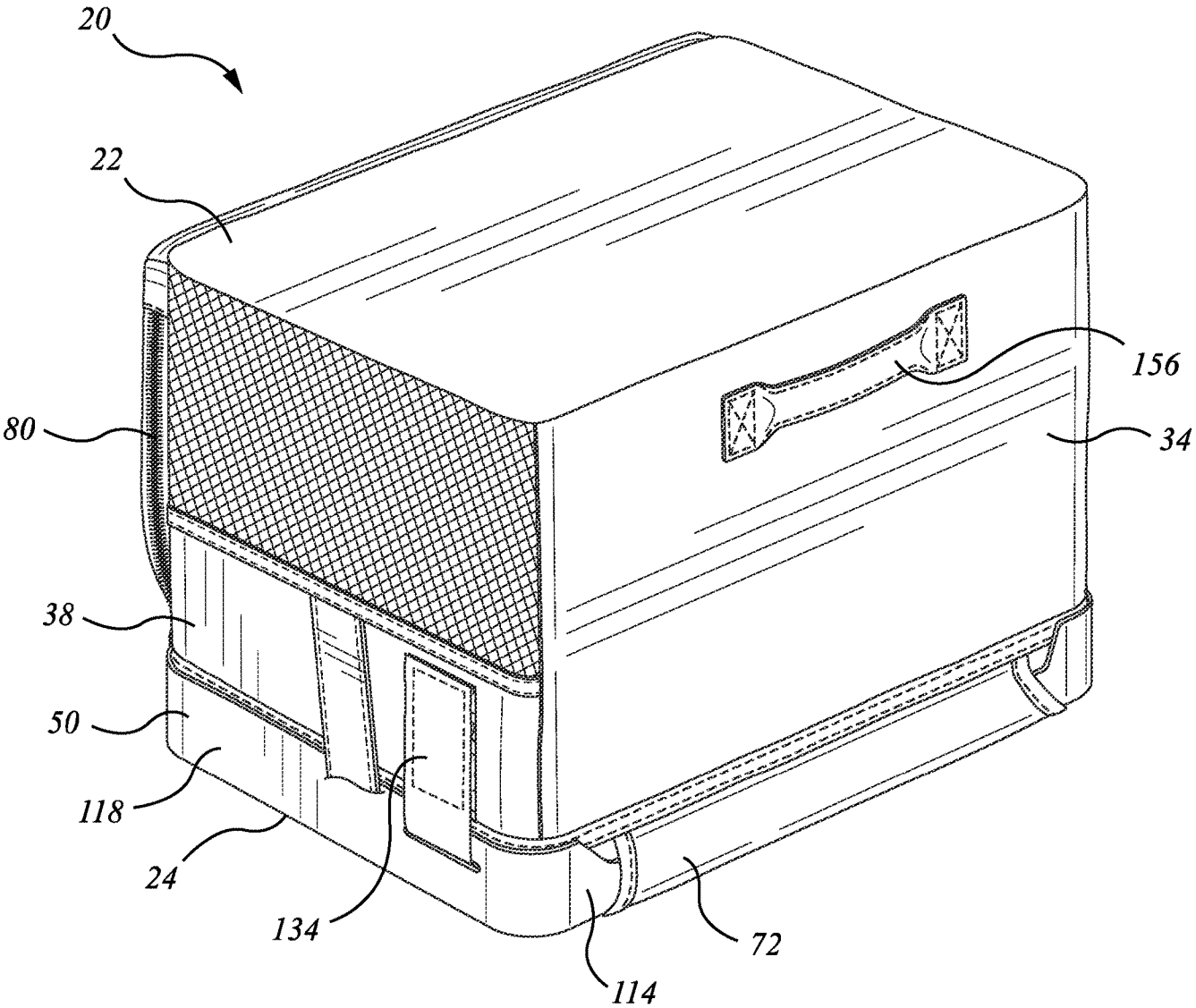
FIG. 4*a* shows an isometric view of the container assembly of FIG. 1*a*; flipped over on its lid preparatory to folding such that the container is seen from the bottom, to the right, and behind.
Figure 4B:
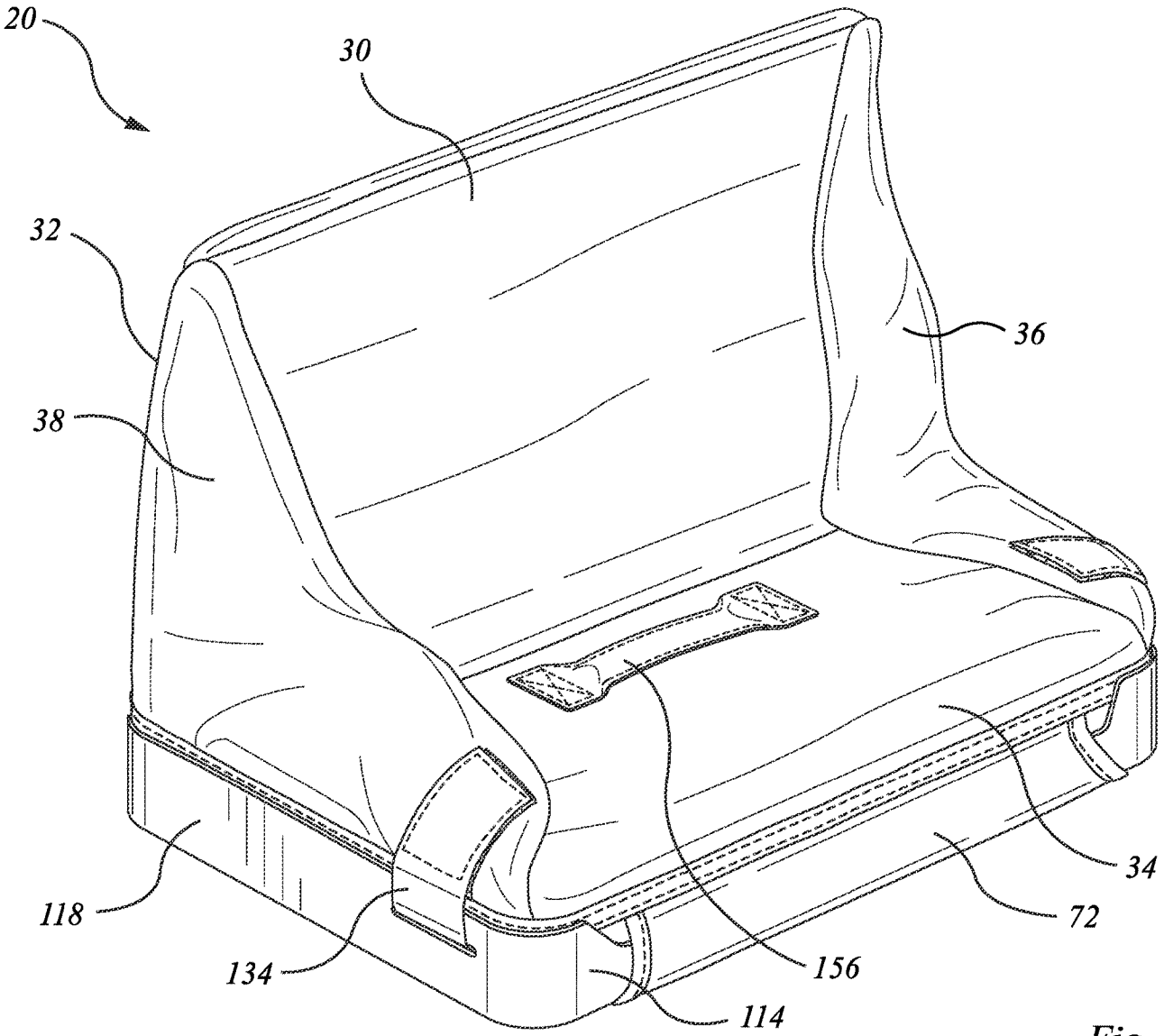
FIG. 4*b* shows the container assembly of FIG. 4*a* in a first step of folding in which the rear panel has been folded in toward the lid.
Figures 4C, 4D, 4E:
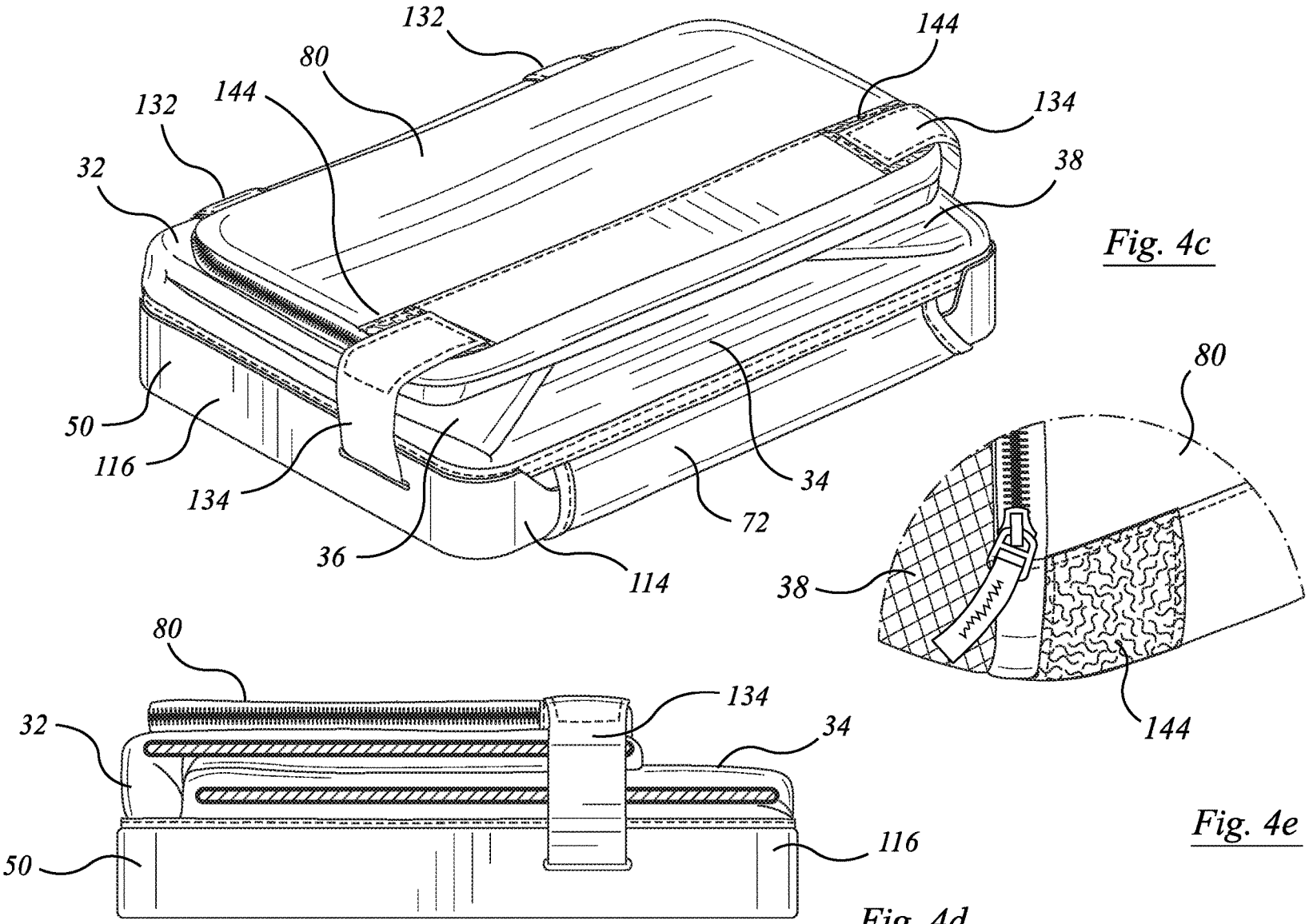
FIG. 4*c* shows the container assembly of FIG. 4*a* in a subsequent step of folding with the front panel folded back over the rear panel and secured in the folded position.
FIG. 4*d* is a side view of the container assembly of FIG. 4*c;*
FIG. 4*e* shows an enlarged detail of the container assembly of FIG. 4*c;*
Figure 5A:
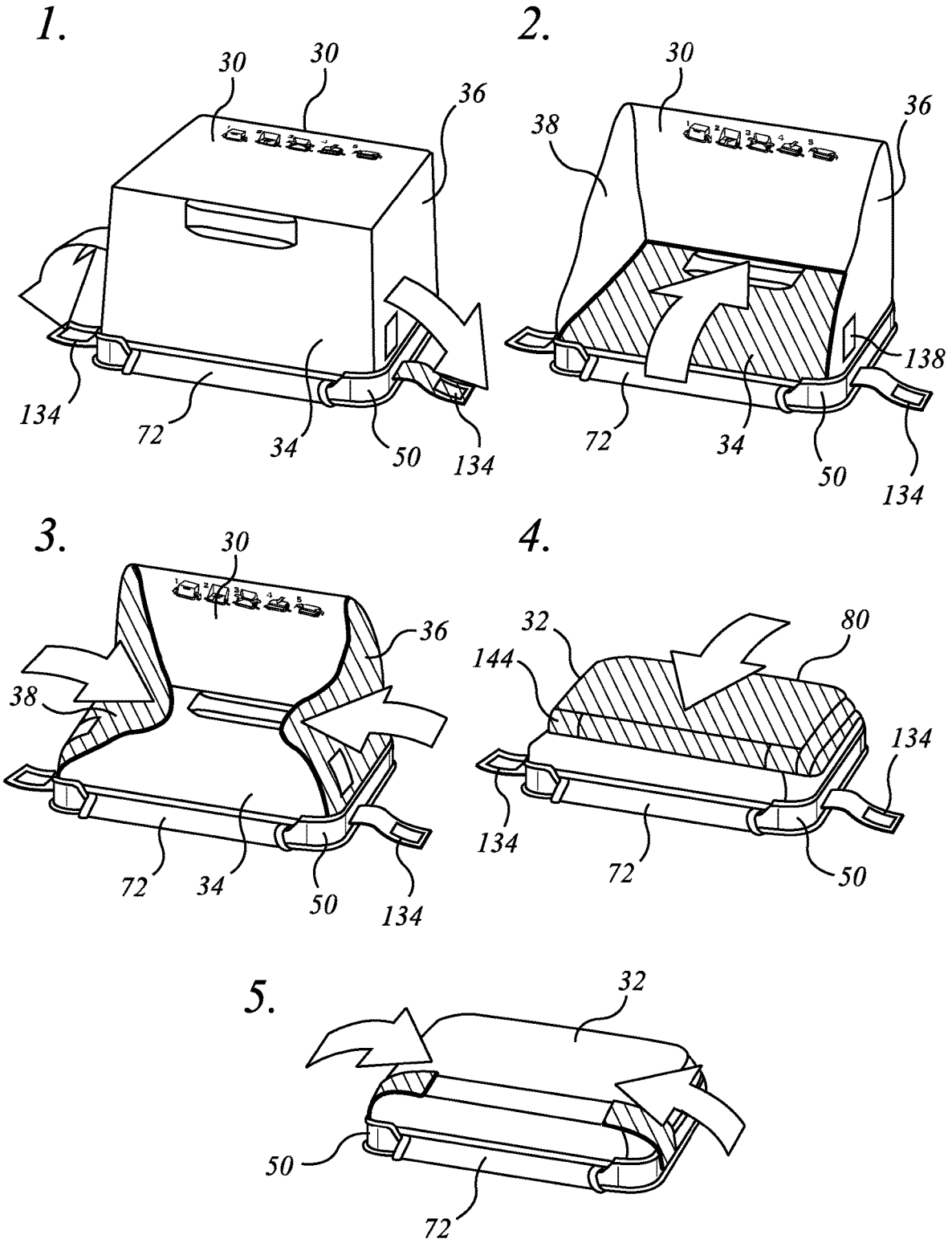
FIG. 5*a* is a schematic of three-dimensional views of the steps 1 through 5 of folding of the container assembly of FIG. 1*a*.
Figure 5B:
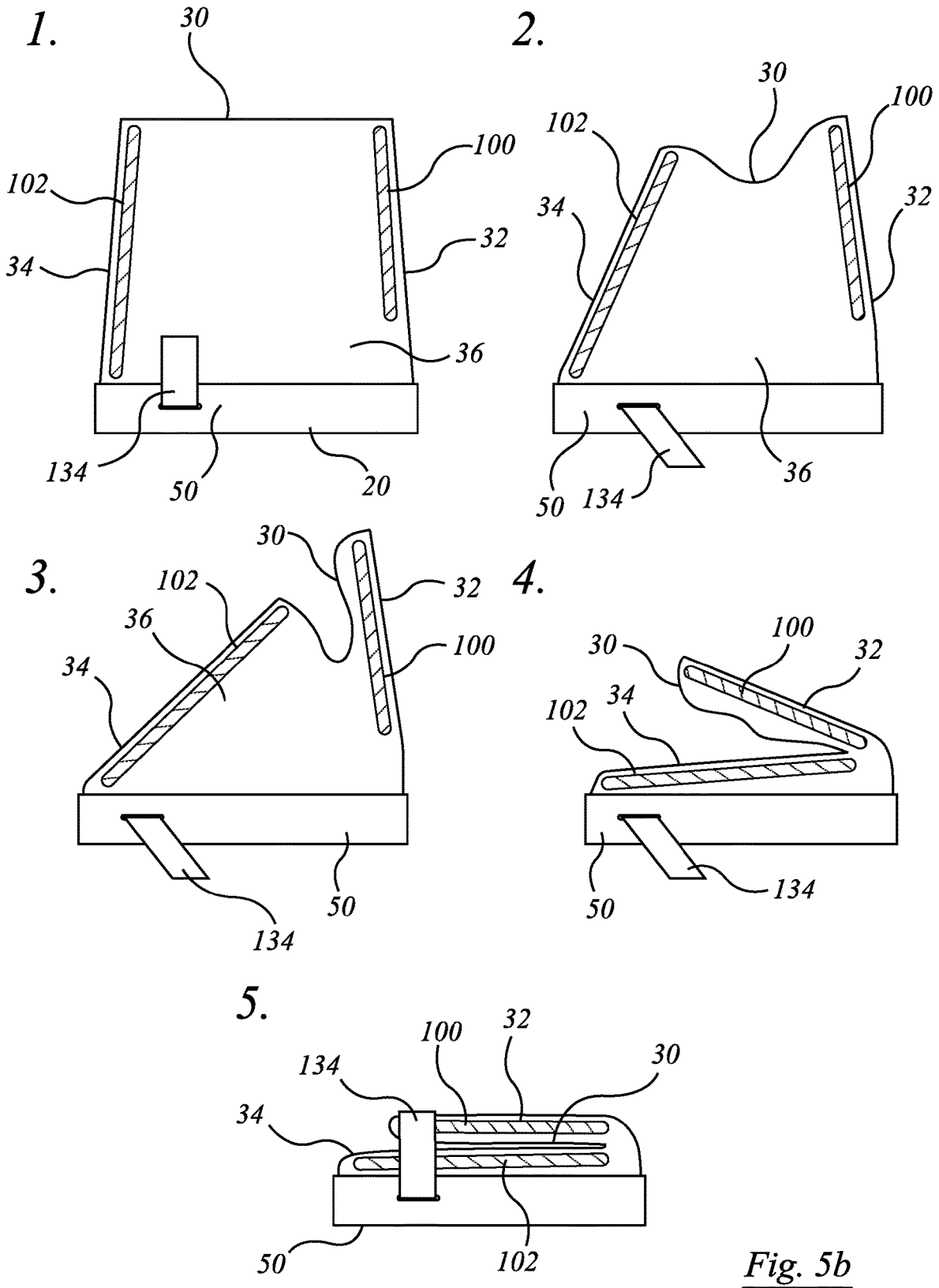
FIG. 5*b* is a schematic of three-dimensional views of the steps 1 through 5 of folding of the container assembly of FIG. 5*a* showing the respective positions of the stiffeners of the front and rear wall panels during folding.

To that end considering the steps shown in FIGS. 4*a*-4*f*, and the five steps seen in FIGS. 5*a* and 5*b*, the deployed positions shown in FIGS. 1*a* and 1*b* can be taken as a starting point. The first step is to invert container assembly 20, i.e., to turn it upside down as shown in FIG. 4*a*. The retainers or attachments defined by straps 134 are released from respective hook-and-eye patches 138. Then rear wall 34 is pivoted forwardly toward front wall 32 and then downwardly to lie against the inside of lid 52. Given the thickness of the soft-sided insulated walls generally, prior to, or as part of, folding rear wall 34 pivotally toward lid 52, left-hand side wall 36 and right-hand side wall 38 may be tugged outwardly away from each other to make it easier to push rear wall 34 forward and downward. Tugging the sidewalls outward also starts to draw rear wall 34 forward, as suggested by steps 1 and 2 in FIG. 5*b*.

As this happens, the movement will tend to cause bottom wall 30 to tend to fold toward front wall 32. As rear wall 34 moves to oppose lid 52, bottom wall 30 will then be drawn to lie against the back of front wall 32. Once rear wall 34 has been pushed as far as it can go toward lid 52, the upstanding side walls will each have a general form of a pair of triangles whose hypotenuse is the folded-over diagonal of the respective side wall. The next step is to push those folded-over diagonal edges toward each other, as in step 3 in FIG. 5*a*. In addition to causing the side wall panels to further tend to fold again roughly into diagonal quarters. As this occurs, front wall 32 and bottom wall 30 will tend to fold backward and downward toward the now-folded rear wall 34. In consequence the now-folded side walls end up being folded between bottom wall 30 and rear wall 34, with front wall 32 lying on top of bottom wall 30 as seen in step 4 in FIG. 5*a*. Finally, once front wall 32 reaches its folded position, straps 134 are re-attached by engaging pads 136 with pads 144. In this way straps 134 also define releasable retainers that are used to secure front wall 32, and therefore container assembly 20 more generally, in the folded position or condition. Whether in folding or unfolding container assembly 20, it may be helpful to use handle 156 to grasp rear wall 34. When container assembly 20 is being folded, handle 156 is used in aiding in pushing rear wall 34 toward lid 52. When container assembly 20 is being unfolded, handle 156 aids in pulling rear wall 34 away from lid 52.

It may be noted that it is to some extent arbitrary which wall is the front and which wall is the rear. That is, hinge 72 could be attached along the top edge of front wall 32 rather than along the top edge of rear wall 34. Therefore, one of the front or rear walls can be designated the "first" wall member, and the other can be designated the "second" wall member. It may be, however that where an auxiliary container is mounted to the front wall, folding will be facilitated if hinge 72 is mounted along the upper margin of rear wall 34, and the larger stiffener 102 is in the rear wall, rather than the less easily folded front wall.

Although the embodiments illustrated and described above are preferred, the principles of the present invention are not limited to this specific example which is given by way of illustration. It is possible to make other embodiments that employ the principles of the invention and that fall within its spirit and scope as defined by the following claims.

We claim:

1. A folding insulated container assembly comprising:

a first portion and a second portion co-operable therewith;

said first portion having a soft-sided insulated wall structure and a receptacle defined therein, said soft-sided insulated wall structure being foldable and said receptacle having an opening;

said second portion being movably connected to said first portion;

said first portion having a first closure member that defines a rigid peripheral frame;

said soft-sided insulated wall structure being releasably mounted to said first closure member;

said soft-sided insulated wall structure having an upper margin;

said rigid peripheral frame defining an accommodation in which said upper margin seats;

said rigid peripheral frame has at least a first securement fitting to which said soft-sided insulated wall structure is mounted when said upper margin is seated in said accommodation;

said second portion including a second closure member;

said second closure member being movable to a first position relative to said first closure member in which said first and second closure members are engaged to obstruct access to said receptable, said first position being a closed position;

said second closure member being movable to a second position relative to said first closure member, said second position defining an open position permitting access to said receptacle;

said first closure member defines a rigid land;

said second closure member defines a stiffened member;

in said closed position of said second closure member relative to said first closure member said stiffened member being operable to engage said rigid land.

2. The folding insulated container assembly of claim 1 wherein said stiffened member defines a protruding nose and said first closure member is a bezel that defines said land, whereby said nose seats in said bezel when said second closure member is in said closed position relative to said first closure member.

3. The folding insulated container assembly of claim 1 wherein, when said second closure member defines a lid of said insulated container assembly; said lid includes a stiffened jamb; in said closed position of said second closure member said jamb fits within said surround and said jamb engages said land in an interference fit.

4. The folding insulated container assembly of claim 1 wherein said surround has an inside skirt, and an outside skirt; said land is defined by said inside skirt; and, when installed said upper margin of said soft-sided insulated wall structure is secured to said outside skirt.

5. A folding insulated container assembly comprising:

a first portion and a second portion co-operable therewith;

said first portion having a soft-sided insulated wall structure and a receptacle defined therein, said receptacle having an opening;

said second portion being movably connected to said first portion;

said first portion having a first closure member that defines a rigid peripheral frame;

said soft-sided insulated wall structure being releasably mounted to said first closure member;

said second portion including a second closure member;

said second closure member being movable to a first position relative to said first closure member in which said first and second closure members are engaged to obstruct access to said receptable, said first position being a closed position;

said second closure member being movable to a second position relative to said first closure member, said second position defining an open position permitting access to said receptacle;

said first closure member defines a rigid land;

said second closure member defines a stiffened member;

in said closed position of said second closure member relative to said first closure member said stiffened member being operable to engage said rigid land;

said rigid peripheral frame defines a surround that includes said land;

said soft-sided insulated wall structure has an upper margin;

said surround has an accommodation; and said upper margin of said soft-sided insulated wall structure seats in said accommodation;

said surround has an inside skirt, and an outside skirt; said land is defined by said inside skirt; and, when installed said upper margin of said soft-sided insulated wall structure is secured to said outside skirt; and said outside skirt has at least a first securement fitting to which said upper margin of said soft-sided insulated wall structure is mounted when installed.

6. The folding insulated container assembly of claim 5 wherein said inside skirt has at least a first relief formed therein that provides installation access to said first securement fitting.

7. The folding insulated container assembly of claim 5 wherein said soft-sided insulated wall structure has at least a first strap; said first securement fitting is a first aperture formed in said outside skirt; said first strap passes through said first aperture of said first securement fitting on installation, and said first strap folds back upon, and is secured to said soft-sided insulated wall structure.

8. The folding insulated container assembly of claim 4 wherein said inside skirt is spaced from and opposed to said outside skirt and said accommodation is defined therebetween.

9. The folding insulated container assembly of claim 1 wherein:

said second closure member defines a lid of said insulated container assembly;

said first closure member is a rigid peripheral frame that defines a surround that includes said land;

said surround has an inside skirt, and an outside skirt;

said inside skirt is spaced from and opposed to said outside skirt and an accommodation is defined in a downwardly opening channel formed therebetween;

said outside skirt has an array of securement apertures spaced thereabout to which a set of straps of said upper margin of said soft-sided insulated wall structure is mounted when installed;

said inside skirt has at least a set of reliefs formed therein that provide installation access for said straps to said array of securement fittings;

said set of straps pass through said set of apertures on installation, and said set of straps fold back upon, and are secured to said soft-sided insulated wall structure; and, when installed.

10. The folding soft-sided insulated container assembly of claim 1, wherein:

said second portion is movable relative to said first portion to govern access to said receptacle through said opening;

said soft-sided insulated wall structure is an upstanding soft-sided insulated wall structure, said upstanding soft-sided insulated wall structure including a bottom wall, a front wall, a rear wall, a left-hand side wall and a right-hand side wall;

each of said bottom wall, front wall, rear wall, left-hand side wall and right-hand side wall having an inside face and an outside face;

said soft-sided insulated container assembly being movable between a first position and a second position;

in said first position one of (a) said rear wall is folded to lie against said second portion with said outside face of said rear wall facing away from said second portion, said left-hand and right-hand side walls being folded toward each other, said bottom wall being folded with said outside face of said bottom wall oriented toward said outside face of said rear wall and with said left-hand and right-hand side walls being between said outside face of said rear wall and said outside face of said bottom wall, and said front wall being folded over said bottom wall with said inside face of said front wall opposing said inside face of said bottom wall, and said front wall overlying said rear wall; and (b) said front wall is folded to lie against said second portion with said outside face of said front wall facing away from said second portion, said left-hand and right-hand side walls being folded toward each other, said bottom wall being folded with said outside face of said bottom wall oriented toward said outside face of said front wall and with said left-hand and right-hand side walls being between said outside face of said front wall and said outside face of said bottom wall, and said rear wall being folded over said bottom wall with said inside face of said rear wall opposing said inside face of said bottom wall, and said front wall overlying said rear wall; and said rear wall overlying said front wall;

in said first position said bottom wall, said right-hand wall and said left hand wall lie between said folded front wall and said folded rear wall; and in said second position said upstanding soft-sided insulated wall structure being unfolded to form an open-topped five-sided box.

11. The folding soft-sided insulated container assembly of claim 10 wherein at least one of said front wall and said rear wall has a stiffening panel therein.

12. The folding soft-sided insulated container assembly of claim 10 wherein both said front wall and said rear wall have stiffening panels therein.

13. The folding soft-sided insulated container assembly of claim 10 wherein said front wall has a first stiffening panel therein, and said rear wall has a second stiffening panel therein, said first and second stiffening panels being of unequal lengths.

14. The folding soft-sided insulated container assembly of claim 13 wherein said second stiffening panel is longer than said first stiffening panel.

15. The folding soft-sided insulated container assembly of claim 10 wherein said receptacle has an opening width measured from said left-hand side wall to said right hand side wall, and an opening depth measured from said front wall to said rear wall; and a rear wall height measured from said bottom wall to said opening; and said rear wall height is less than said opening depth.

16. The folding soft-sided insulated container assembly of claim 10 wherein said second portion defines a lid, and said lid is hinged to said rear wall.

17. The folding soft-sided insulated container assembly of claim 1 wherein said second portion defines a lid, and said lid is rigid.

18. The folding soft-sided insulated container assembly of claim 1 wherein said first portion of said soft-sided insulated container assembly includes a rigid frame defining a surround of said opening of said receptacle.

19. The folding soft-sided insulated container assembly of claim 18 wherein said soft-sided insulated wall structure is detachable from said rigid frame of said surround.

20. The folding soft-sided insulated container assembly of claim 10 wherein said rear wall has a handle mounted thereto.

21. The folding soft-sided insulated container assembly of claim 18 wherein said second portion defines a lid, and said lid has a rigid depending jamb, and when said lid is closed relative to said receptacle said jamb engages said rigid frame in a friction fit.

22. The folding soft-sided insulated container assembly of claim 21 wherein said assembly has a secondary closure that is engageable when said lid is closed relative to said receptacle, said secondary closure providing additional securement of said lid in said closed position.

23. The folding soft-sided insulated container assembly of claim 10 wherein said first portion has at least one securement operable to retain said assembly in said first position.

* * * * *